US005797247A

United States Patent [19]

Nakagoshi et al.

[11] Patent Number: 5,797,247

[45] Date of Patent: Aug. 25, 1998

[54] PHOTOSENSITIVE MATERIAL PACKAGE AND PACKAGING APPARATUS FOR THE SAME

[75] Inventors: Isao Nakagoshi; Hiromi Shimura; Ikuo Katsumata; Osamu Suzuki, all of Minami-ashigara, Japan

[73] Assignee: Fuji Photo Film Co., Ltd., Kanagawa, Japan

[21] Appl. No.: 852,338

[22] Filed: May 7, 1997

Related U.S. Application Data

[62] Division of Ser. No. 518,836, Aug. 24, 1995, Pat. No. 5,667,071.

[30] Foreign Application Priority Data

Aug. 31, 1994 [JP] Japan ..... 6-206216

[51] Int. Cl.[6] ..... B65B 53/02; B65B 13/02

[52] U.S. Cl. ..... 53/442; 53/399; 53/412; 53/133.8; 53/586; 53/557; 53/374.4

[58] Field of Search ..... 53/399, 412, 442, 53/459, 466, 133.8, 586, 585, 567, 557, 374.4

[56] References Cited

U.S. PATENT DOCUMENTS

| | | | |
|---|---|---|---|
| 3,513,622 | 5/1970 | Timmerbeil | 53/557 X |
| 3,675,389 | 7/1972 | Uline | 53/557 X |
| 3,766,708 | 10/1973 | Kubo et al. | 53/557 X |
| 3,933,244 | 1/1976 | Hughes et al. | 206/497 |
| 4,078,659 | 3/1978 | Rensner | 206/497 |
| 4,289,236 | 9/1981 | Ganz et al. | 206/422 |
| 4,441,650 | 4/1984 | Caldwell et al. | 206/497 |
| 4,586,312 | 5/1986 | Limousin | 53/442 X |
| 4,844,961 | 7/1989 | Akao | 206/455 |
| 4,971,197 | 11/1990 | Worley | 206/497 |
| 5,020,669 | 6/1991 | Nakagoshi | 206/466 |
| 5,054,269 | 10/1991 | Leino | 53/374.4 X |
| 5,179,819 | 1/1993 | Sukeyasu et al. | 53/557 X |
| 5,290,613 | 3/1994 | Shuetz et al. | 428/34.9 |

FOREIGN PATENT DOCUMENTS

| | | | |
|---|---|---|---|
| 156713 | 10/1985 | European Pat. Off. | 53/557 |
| 1461925 | 1/1969 | Germany | 53/557 |
| 3835993 | 5/1989 | Germany | 53/557 |
| 52-148930 | 2/1977 | Japan . | |
| 54-67421 | 5/1979 | Japan | G03C 3/00 |
| 58-113653 | 8/1983 | Japan | B65D 73/00 |
| 6222513 | 8/1997 | Japan | 206/455 |

*Primary Examiner*—Linda Johnson

*Attorney, Agent, or Firm*—Sughrue, Mion, Zinn, Macpeak & Seas, PLLC

[57] ABSTRACT

One package for photographic film (PF) has five cassettes (3), which respectively contain the photographic film (PF). Five cylindrical watertight cases (2) respectively contain the cassettes (3). Heat shrinkable film (7, 25, 30, 57) is disposed around the five watertight cases (2), and shrunken by heat for collectively covering the five cassettes (3). The shrinkable film (7, 25, 30, 57) has shrinkability from 40 to 63% when heated at 140° C. for 10 seconds, and has thickness from 35 to 50 μm.

20 Claims, 16 Drawing Sheets

PHOTOSENSITIVE MATERIAL PACKAGE AND PACKAGING APPARATUS FOR THE SAME

This is a divisional of application Ser. No. 08/518,836 filed Aug. 24, 1995 now U.S. Pat. No. 5,667,071.

BACKGROUND OF THE INVENTION

1. Field of the Invention

The present invention relates to a photosensitive material package inclusive of photographic film for example, and a packaging apparatus for the same. More particularly, the present invention relates to a photosensitive material package and a packaging apparatus in which a plurality of photo-sensitive materials can be collectively packaged.

2. Description Related to the Prior Art

Photographic film and photographic paper are photosensitive material, which is wound in a roll form and contained in a container called a cassette, cartridge or magazine (hereinafter referred to simply as a cassette) for the convenience in the handling. The cassette has a slit-like passage mouth for the purpose of unwinding and rewinding of the photosensitive material, and is not watertight. To protect the photosensitive material from moisture after the manufacture and before use, generally the cassette is contained in a single watertight case. The 135 type photo film is contained in a cassette of metal, which is contained in a plastic cylindrical "P case" as a watertight case, and further covered in a packaging box of paper in a form to be sold.

The photographic film of a 135 type sold commercially at the retail level. Sometimes packages having a plurality of photographic films are sold. JP-U (Japanese Utility Model Laid-open Publication No.) 52-148930 discloses a package in which a single packaging box covers plural P cases each of which contains a photo film cassette. Examples of packages with heat shrinkable film having perforations are disclosed in JP-U 58-113653, JP-A (Japanese Patent Laid-open Publication No.) 54-67421 and U.S. Pat. No. 5,020,669 (corresponding to JP-Y (Japanese Utility Model Publication No.) 6-17743), which are characterized by ease of packaging, and a structure with both "product virginity" (originality) and "openability", namely a structure openable easily prior to use after the purchase.

The conventional packaging apparatus wraps an object in shrinkable film loosely at first, and subjects a number of spots on the shrinkable film to heat sealing. The object covered in the shrinkable film is transported into a shrinking tunnel, through which the shrinkable film is heated so that the shrinkable film is tightly fitted around the object.

The package disclosed in JP-U 52-148930 has shortcomings of high cost of packaging material and producing operation utilizing adhesive agent, because a packaging box of paper is used for packaging plural P cases collectively. It is likely that the packaging box is torn during transportation or upon an accidental drop. It is difficult to keep virginity of products in consistency with openability. The package disclosed JP-U 58-113653 is a base sheet together with shrinkable film: the base sheet has perforations, and a plurality of dry batteries are tightly wrapped on the base sheet collectively block by block along trains of the perforations. There is little restriction in designing a process of packaging with the shrinkable film, because the packaged objects are the dry batteries. It is impossible to utilize the disclosure of this document for packaging of a plurality of photosensitive material.

JP-U 54-67421 discloses a package inclusive of perforated shrinkable film packaging a single P case which contains a cassette, in a fashion where a cap of the P case is prevented from being removed and the cassette has product virginity and openability. However this document does not disclose packaging of a plurality of P cases collectively in shrinkable film. It is impossible for the disclosure to solve problems in collective packaging, namely to achieve consistency of the product virginity and openability regarding each single cassette, and to avoid a visually unpleasant appearance with too many wrinkles of. U.S. Pat. No. 5,020,669 discloses that each P case contains a cassette and is contained in a box, and that a plurality of boxes with such P cases are packaged in shrinkable film. There is a problem in high cost for the packaging, as the boxes as an intermediate packaging material for the respective cassettes are included.

The conventional packaging apparatuses have difficulties in packaging an object in shrinkable film. They have complex mechanisms, high cost, and are slow in operation.

A number of spots on the shrinkable film are subjected to heat sealing. The packaging operation is slower further when the number of spots for the heat sealing is increased.

SUMMARY OF THE INVENTION

In view of the foregoing problems, an object of the present invention is to provide a photosensitive material package, in which the product virginity and openability are maintained and which can be produced at a low cost.

Another object of the present invention is to provide a photosensitive material package, in which the quality of the photosensitive material is not affected by the packaging process.

Still another object of the present invention is to provide a packaging apparatus for a photosensitive material package, which is capable of effecting a packaging process with high efficiency.

In order to achieve the above and other objects and advantages of this invention, a photosensitive material package includes N cassettes respectively for containing photosensitive material. N cylindrical watertight cases respectively contain the cassettes. Heat shrinkable film is disposed around the N watertight cases, and shrunken by heat for collectively covering the N cassettes, the shrinkable film having shrinkability from 40 to 63% when heated at 140° C. for 10 seconds and having thickness from 35 to 50 μm.

In the present invention, the product virginity and openability are maintained and the collective package can be produced at a low cost.

To package photosensitive material, N of the cassettes are pre-contained in respective cylindrical watertight cases. At least one continuous heat shrinkable film material is supplied to a top and a bottom of the N cassettes. The shrinkable film material is guided, to cause the shrinkable film material to cover the N cassettes. A rear edge portion and a front edge portion of the shrinkable film material are sealed with heat, the rear edge portion being disposed upstream from initial the N cassettes covered in the shrinkable film material, and the front edge portion being disposed downstream from the next group of N cassettes to be covered in the shrinkable film material. The rear edge portion is cut from the front edge portion. The next N cassettes are pressed toward the front edge portion sealed with heat while the shrinkable film material covers the next N cassettes. Heat is applied to the shrinkable film piece with initial the N cassettes, to fit the shrinkable film piece tightly on the watertight cases.

The quality of the photosensitive material is not affected by packaging process. The packaging apparatus is capable of effecting a packaging process at a high efficiency.

In a preferred embodiment, the shrinkable film material is transported while sandwiching the N cassettes with the shrinkable film material, to cause the shrinkable film material to cover the N cassettes. A rear edge portion and a front edge portion of the shrinkable film material are sealed with heat, the rear edge portion disposed upstream from initial the N cassettes is covered in the shrinkable film material, and the front edge portion disposed downstream from next N cassettes is to be covered in the shrinkable film material. The rear edge portion is cut from the front edge portion. Heat is applied to the shrinkable film piece with initial the N cassettes, to fit the shrinkable film piece tightly on the watertight cases.

In another preferred embodiment, at least one perforation train is formed in a continuous shrinkable film material, the shrinkable film material being pre-formed in a tubular shape. A shrinkable film piece is cut from the shrinkable film material at a regular length. Plural rotatable holders are arranged in radially directed fashion, the holders are each adapted to holding N cassettes at one time. One of the holders is supplied with the N cassettes associated with the watertight cases in a direction toward a center of arrangement of the holders. The shrinkable film piece is caused to cover the one holder, by opening the shrinkable film piece in the tubular shape, while the N cassettes are held in the one holder. Heat is applied to one end of the shrinkable film piece about the one holder, in the direction toward the center, to close the one end of the shrinkable film piece. The N cassettes are moved away from the center of the arrangement of the holders, to exit the N cassettes with the shrinkable film piece from the one holder. Heat is applied to the shrinkable film piece with the N cassettes, to fit the shrinkable film piece tightly on the watertight cases.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
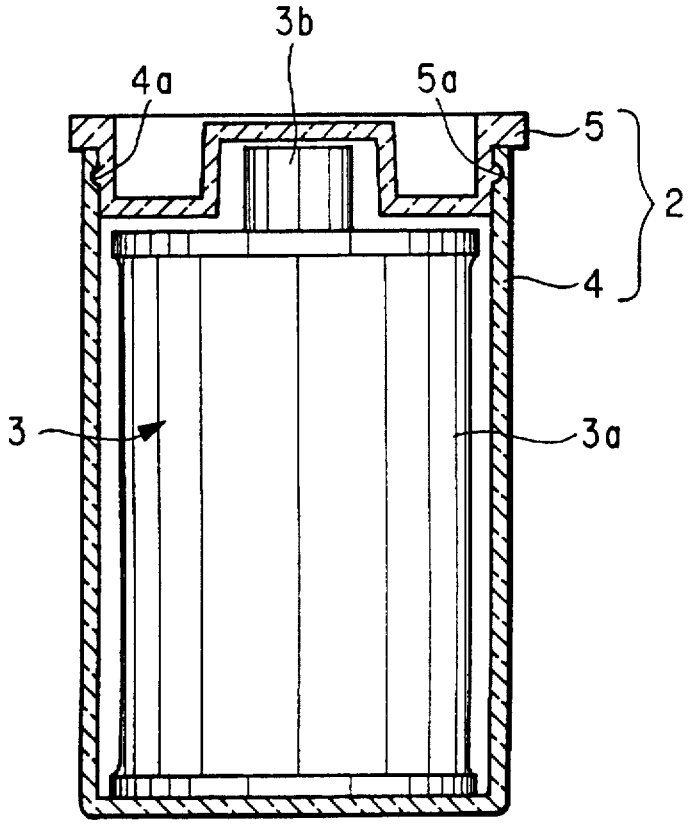
FIG. 1 is a vertical section illustrating a P case containing a photo film cassette.
Figure 1A:
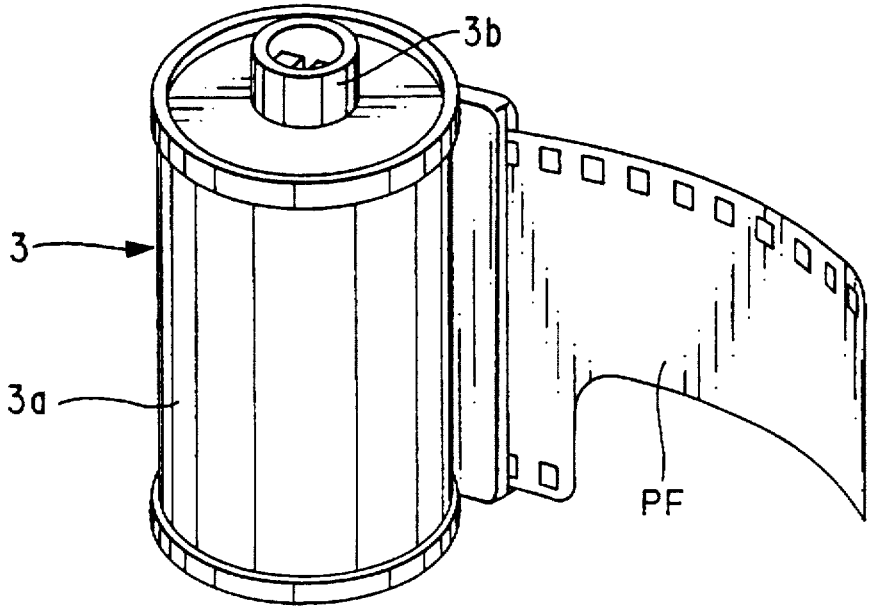
FIG. 1A is a perspective view illustrating the photo film cassette.

In FIG. 1, a P case 2 contains a photo film cassette 3. The photo film cassette 3, in FIG. 1A, has a cassette shell 3*a* of metal and a spool 3*b* contained in the cassette shell 3*a* in a rotatable fashion. Photo film PF is wound on the spool 3*b* in a roll form. Note that the present invention also is applicable to packaging of a leader-advancing type of photo film cassette, in which a photo film is entirely pre-contained in a cassette shell, and rotation of a spool causes a leader of the photo film to advance to the exterior of the cassette shell.

The P case 2 includes a case body 4 of a cylindrical shape and a cap 5 fitted thereon. Both of the case body 4 and the cap 5 are single pieces formed from plastic. The P case 2 protects the photo film cassette 3 from moisture, dust and pressing load. When the cap 5 is fitted on the case body 4 with the photo film cassette 3 contained, a ridge 5*a* in the cap 5 is fitted in a recess 4*a* on the case body 4, to enclose the photo film cassette 3 in the P case 2 tightly.

Figure 2:
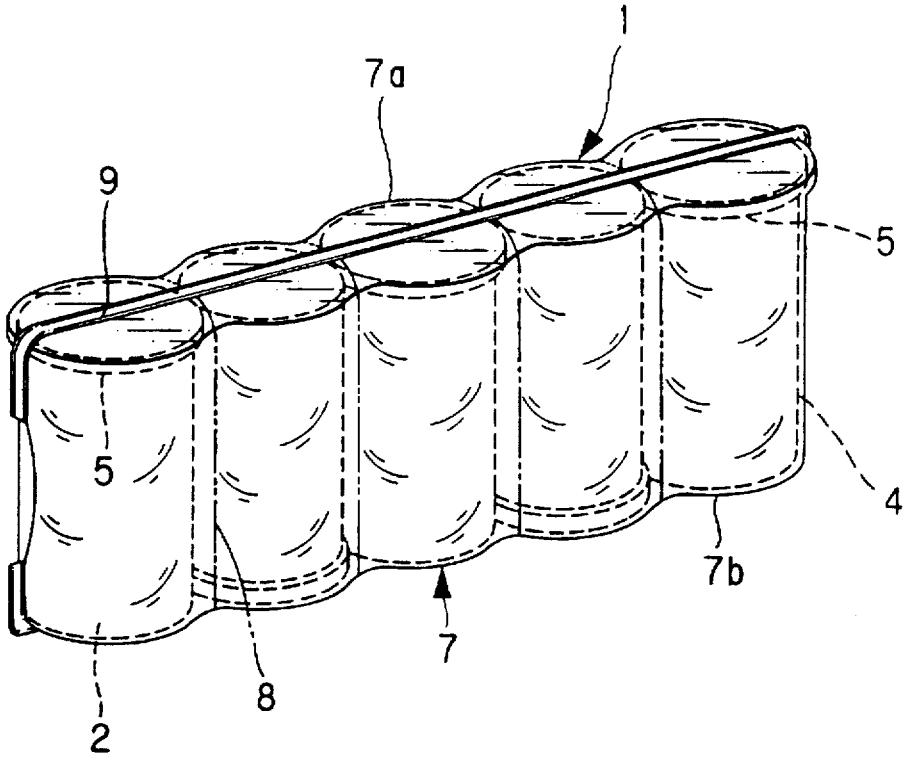
FIG. 2 is a perspective view illustrating a collective package containing five cassettes.

FIG. 2 illustrates a collective package 1 inclusive of the five P cases 2 containing the photo film cassettes 3, and a shrinkable film 7 wrapping the P cases 2. The P cases 2 are so arranged that the cap 5 is alternatively directed to the top and bottom. The P cases 2 are tightly packaged in the shrinkable film 7 after shrinking. Note that it is of course possible to direct the cap 5 commonly in a single direction.

Trains of perforations 8 are formed in the shrinkable film 7 and along borders between the P cases 2. The perforation trains 8 are used before use of the cassette. The shrinkable film 7 is torn along one of the perforation trains 8, to remove the P case 2 without affecting to the remaining ones of the P cases 2. The perforation trains 8 have a tensile strength from 500 to 630 gf per 15 mm width of the perforated portion. This range is favorable in avoidance of breaking the perforation trains 8 due to the vibration of the collective package 1 or shock upon an accidental drop. The perforation trains 8 as such keep the originality and the easy openability of the collective package 1. Note that the shrinkable film 7 with the perforations is formed from two film pieces, which are attached along junctures 9 by means of heat sealing. The junctures 9 appear on the top and the bottom of the collective package 1.

Figure 3:
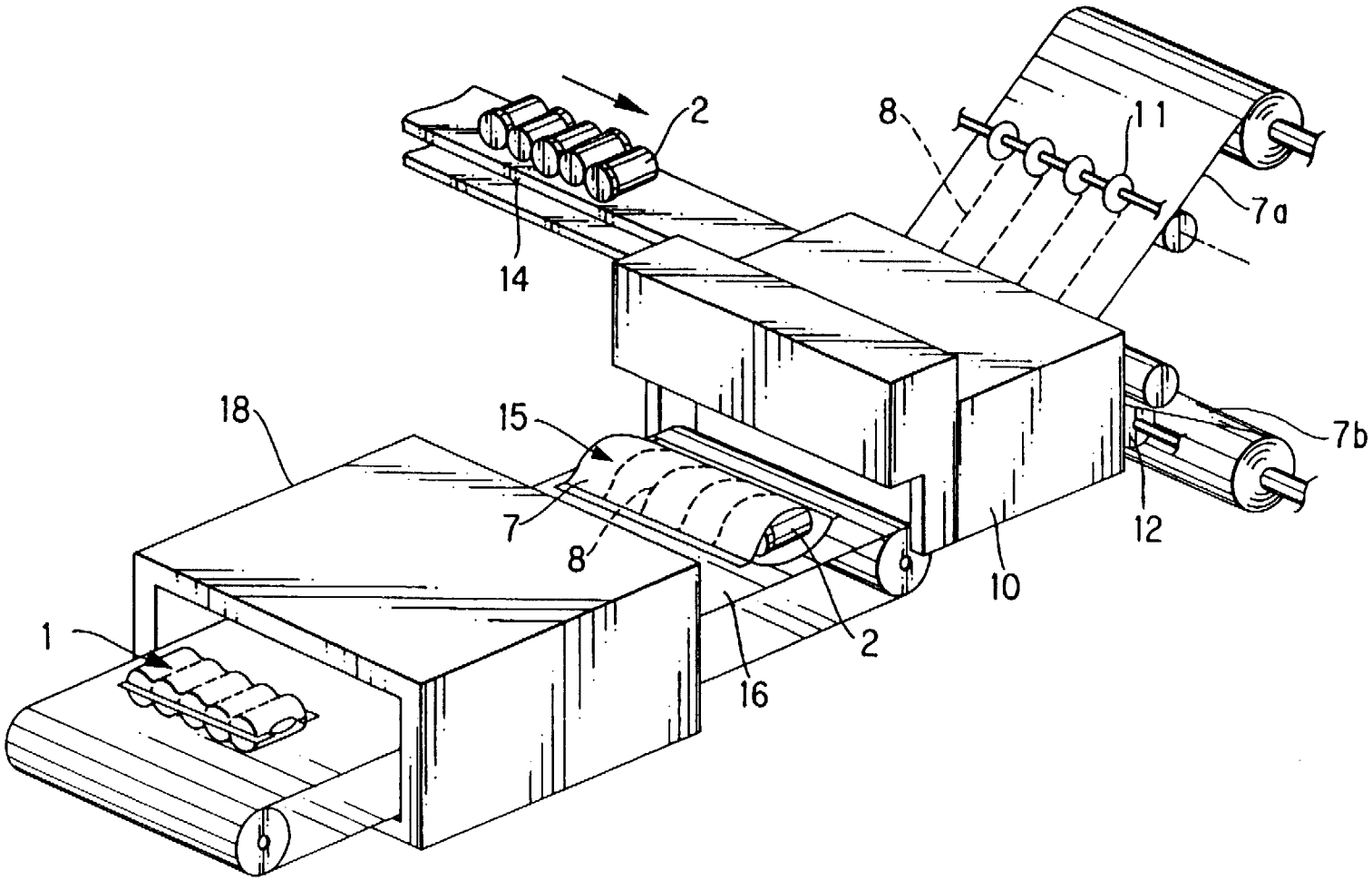
FIG. 3 is a perspective view illustrating a packaging apparatus.
Figure 4:
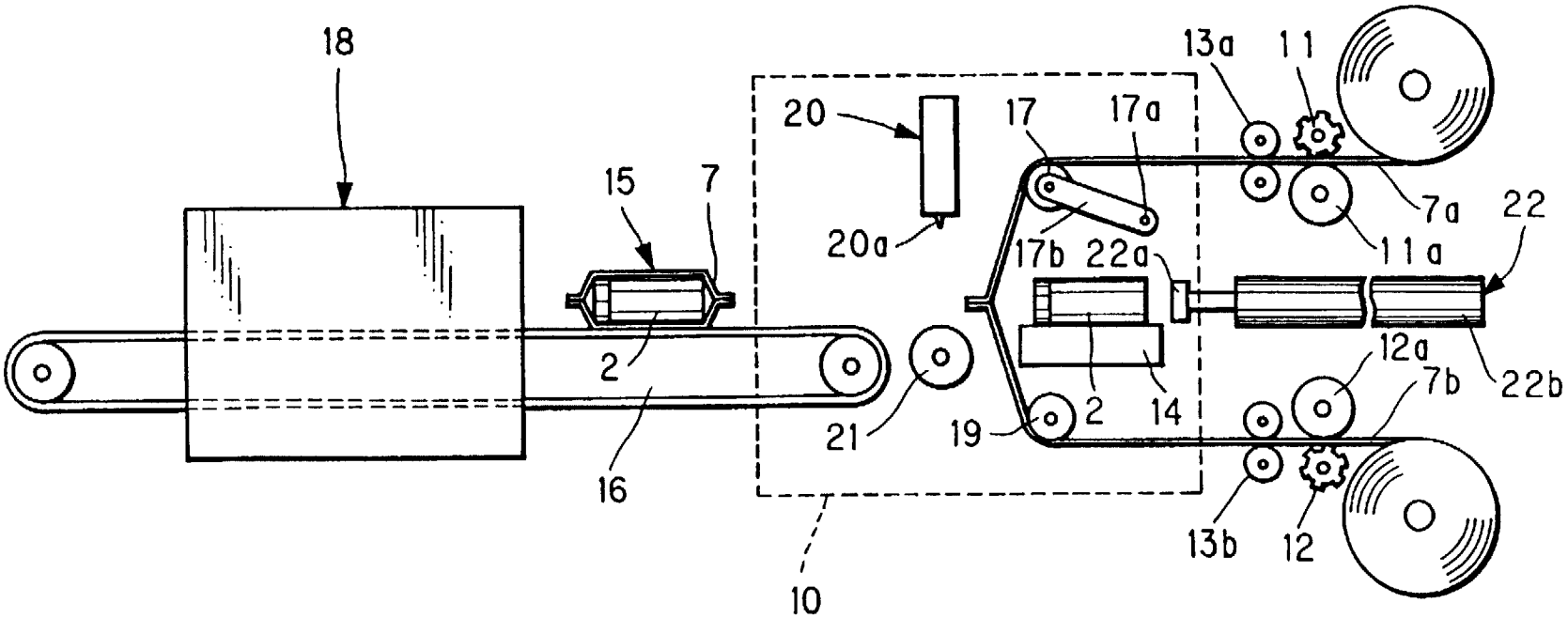
FIG. 4 is a schematic view in section, illustrating the packaging apparatus.

FIGS. 3 and 4 schematically illustrate a packaging apparatus for producing the collective package 1 in FIG. 2. The film materials 7*a* and 7*b* are wound in rolls, and are supplied to a wrapping unit 10. In the middle of a transport path of the film material 7*a* are disposed a bladed wheel 11 for forming each of perforation trains 8 and a roller 11*a* confronting the bladed wheel 11 while squeezing the film material 7*a*. In the middle of a transport path of the film material 7*b* are disposed a bladed wheel 12 and a roller 12*a*. There are supply roller sets 13*a* and 13*b* disposed downstream from the bladed wheels 11 and 12, and to transport the film materials 7*a* and 7*b* to the wrapping unit 10.

The film materials 7*a* and 7*b* are transported into the wrapping unit 10, where guide rollers 17 and 19 change a path of the film materials 7*a* and 7*b* downstream from the supply roller sets 13*a* and 13*b*. A sealing pad 20 contains a heater. A roller 21 is confronted with the sealing pad 20. Front ends of the film materials 7*a* and 7*b* are heat-sealed together when the film materials 7*a* and 7*b* are squeezed between the sealing pad 20 and the receiving roller 21. The guide roller 19 is rotatable. The guide roller 17 is secured to an arm 17*b* in rotatable fashion. The arm 17*b* is rotatable in a counterclockwise direction about a shaft 17*a*. The arm 17*b* is biased by a spring (not shown) in the clockwise direction.

A supply belt 14 is directed to the wrapping unit 10, and supplies the five P cases 2 to a position between the film materials 7*a* and 7*b*. A pressing mechanism 22 is disposed behind the P cases 2 with reference to the transportation of the film materials 7*a* and 7*b*, and operates to press the P cases 2 to the attached portion between the film materials 7*a* and 7*b*. The pressing mechanism 22 consists of a pressing member 22*a* and a solenoid 22*b*. The pressing member 22*a* is driven by the solenoid 22*b* to press the P cases 2. Note that also it is possible to use a cam, an air cylinder, or the like.

The five P cases 2, moved by the pressing member 22*a*, are transported downstream beyond the sealing pad 20. The film materials 7*a* and 7*b* are caused to move in cooperation of the P cases 2. The guide roller 17 is pressed by the film material 7*a*, which swings the arm 17*b* in the counterclockwise direction against the bias of the spring. Accordingly the film material 7*a* is contacted on the top of the P cases 2. The course of the film material 7*a* is changed. The sealing pad 20 is prevented from interfering the film material 7*a*.

Figure 5:
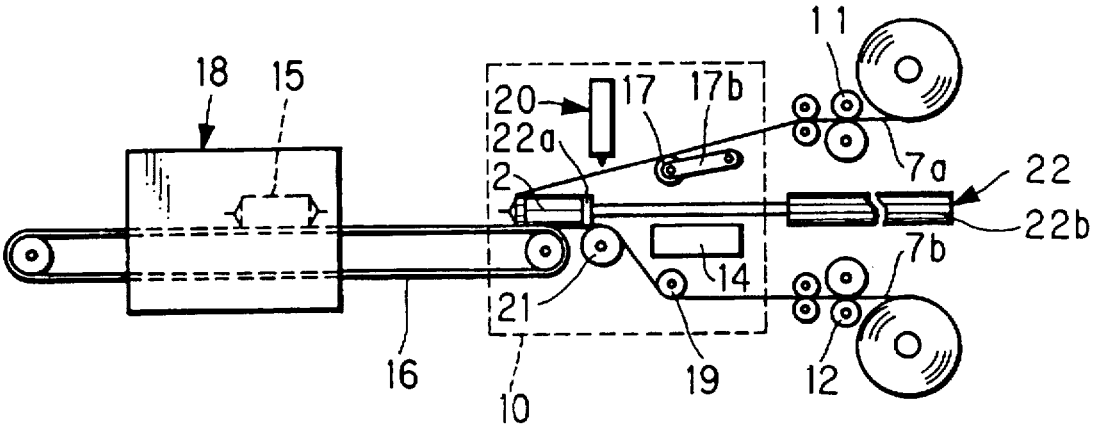
FIG. 5 is a schematic view illustrating a state in the packaging apparatus where P cases are moved toward shrinkable film materials.
Figure 6:
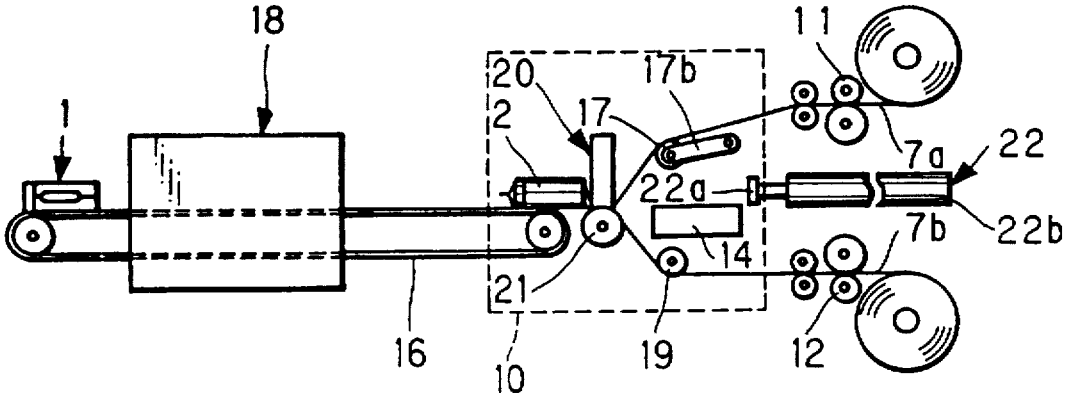
FIG. 6 is a schematic view illustrating a state in the packaging apparatus where shrinkable film materials are sealed with heat.

As illustrated in FIG. 6, the pressing member 22*a* is drawn back by the solenoid 22*b*. The sealing pad 20 is lowered by a cam, solenoid or air cylinder, and squeezes the film materials 7*a* and 7*b* between it and the receiving roller 21, to heat-seal the film materials 7*a* and 7*b* on one another. A blade 20*a* is incorporated in the sealing pad 20 for cutting the shrinkable film 7. A heat-sealed portion is cut through its center by the blade 20*a*. The five P cases 2 are loosely wrapped in the shrinkable film 7, and covered in a sleeve-like arrangement. A workpiece 15 is transported by a transport belt 16 to the left in FIGS 5 and 6.

The arm 17*b* is swung back to its home position by the spring. The film materials 7*a* and 7*b* once again come to have the position depicted in FIG. 4, to receive five other P cases. The P cases 2 can be efficiently packaged, as a rear end of the shrinkable film 7 for the first set of the P cases 2 is heat-sealed at the same time as a front end of the shrinkable film 7 for the second set of the P cases is heat-sealed.

The transport belt 16 is continuously moved at a regular speed. The workpiece 15 is passed through a shrinking tunnel 18. The shrinking tunnel 18 has a heater, which generates heat inside the shrinking tunnel 18 to shrink the shrinkable film 7 thermally at a suitable ratio. Upon passing of the workpiece 15 through the shrinking tunnel 18, a collective package 1 is produced with the shrinkable film 7 shrunken and fitted outside the P cases 2.

The collective package 1 has the junctures 9 in a significantly great size between the film materials 7*a* and 7*b*. The junctures 9 are so great because the junctures 9 between the film materials 7*a* and 7*b* should be kept from being torn when the pressing mechanism 22 presses the P cases 2. Note that the packaging apparatus has performance of producing approximately 20 to 25 collective packages 1 per minute.

Of course the photo film is heated while the workpiece 15 is passed through the shrinking tunnel 18. Should the photo film be overheated, there would occur a phenomenon called "thermal fogging". It is necessary suitably to determine the temperature in the shrinking tunnel 18 and a duration for passing the workpiece 15 through the shrinking tunnel 18. Should the photo film be heated insufficiently, the shrinkable film 7 could not be shrunken to a sufficient extent and this tightness of the shrinkable film 7 would be excessively low. Or else the collective package 1 would have too many wrinkles to cause a visually unpleasant appearance.

It is necessary sufficiently to consider characteristics of the shrinkable film 7, inclusive of heat shrinkability, direction of film stretch, and thickness of the shrinkable film 7. Results of the Inventors experimental determination of preferred characteristics are referred to as follows:

For the shrinkable film 7 with the perforation trains, uniaxial stretched film of polyethylene (PE) was used. Samples A–E were prepared at a common magnitude of the stretch and different thickness: 30 μm, 35 μm, 40 μm, 50 μm and 60 μm. Physical characteristics were measured, of which the results are indicated in Table 1. To measure the heat shrinkability, a square of 5×5 cm was previously marked on each of the samples. They were sunken in a glycerine bath for 10 seconds and at temperature of various values. A length of the side of the square after the heating was subtracted from a length of the side of the square before the heating, to obtain a difference δL. According to this, the heat shrinkability (in %) was calculated as:

$$(\delta L/5)\times 100$$

In Table 1, "haze" is a characteristic representing a degree of opacity in percentage. The haze 0% represents complete transparency. The haze 100% represents complete opacity. The thicker the PE film, the more opaque it is in white color, to lower the transparency.

TABLE 1

| | Samples | | | | |
|---|---|---|---|---|---|
| Characteristics | A | B | C | D | E |
| Thickness (μm) | 30 | 35 | 40 | 50 | 60 |
| Tensile strength (kg/cm²) | | | | | |
| Vertical | 0.96 | 1.05 | 1.16 | 1.40 | 1.70 |
| Horizontal | 0.68 | 0.75 | 0.83 | 0.91 | 1.20 |
| Elongation (%) | | | | | |
| Vertical | 471 | 433 | 396 | 333 | 280 |
| Horizontal | 978 | 896 | 821 | 690 | 580 |
| Tear load (g) | | | | | |
| Vertical | 805 | 846 | 889 | 981 | 1084 |
| Horizontal | 241 | 254 | 274 | 294 | 324 |

TABLE 1-continued

| Characteristics | Samples A | B | C | D | E |
|---|---|---|---|---|---|
| Shock strength (kg · cm) | 4.23 | 4.65 | 5.12 | 6.20 | 7.50 |
| Haze (%) | 4.3 | 4.7 | 5.2 | 6.2 | 7.4 |
| Heat shrinkability (%) | | | | | |
| 90° C. | 1.2 | 1.1 | 1 | 0.8 | 0.7 |
| 100° C. | 6.0 | 5.5 | 5 | 4.0 | 3.5 |
| 110° C. | 26 | 24 | 22 | 18 | 15 |
| 120° C. | 51 | 47 | 43 | 35 | 30 |
| 130° C. | 61 | 56 | 51 | 42 | 37 |
| 140° C. | 69 | 64 | 59 | 48 | 42 |

wherein the tensile strength was measured according to the JIS-Z-1702 standard;

the tear load was measured according to the JIS-Z-1707 and Elmendorf tear testing standards;

the shock strength was measured according to the ASTM D-781 standards;

the haze was measured according to the ASTM D1003 standard.

Samples F, G, H, I and J were produced by changing the magnification in stretching while the thickness was maintained at 40 μm. Heat shrinkability of these samples were measured as in Table 2:

TABLE 2

| Characteristics | Samples F | G | H | I | J | Notes |
|---|---|---|---|---|---|---|
| Heat shrinkability (%) | 20 | 30 | 40 | 50 | 60 | Heated 10 sec. at 140° C. |
| Thickness (μm) | 40 | 40 | 40 | 40 | 40 | Stretch changed |

Comparable Samples K and L were prepared by use of biaxial oriented polyethylene film. Heat shrinkability of these samples were measured as in Table 3:

TABLE 3

| Characteristics | Samples K | L |
|---|---|---|
| Material | PE | PE |
| Thickness (μm) | 40 | 40 |
| Heat shrinkability (%) | | |
| Vertical | 43 | 10 |
| Horizontal | 42 | 50 |

All the samples in Tables 1–3 were actually packaged by the packaging apparatus in FIG. 3, subjected to experiments, and evaluated regarding appearance, affects to the image quality of the photo film, resistance to drop, originality (i.e. guaranteed virginity) of product, and the like. Conditions of the shrink wrapping are illustrated in Table 4. The amount of transporting the film materials *7a* and *7b* was so determined that the volume inside the sleeve shape formed with the two pieces of the shrinkable film was 525 $cm^3$, namely approximately twice as large as a volume of the five P cases. The temperature inside the shrinking tunnel 18 was set 140° C. Time of heating the film materials *7a* and *7b* was set as 12 seconds by suitably moving the transport belt 16.

TABLE 4

Film width: 185 mm, in view of containing five cassettes;

Packaging type: sleeve type, by supplying two film materials simultaneously from respective upper and lower film rolls;

Perforation forming: prior to shrinking, by rotating bladed wheels at the rolls, at the pitch 1:2 as proportion of a length of each of the perforations to an interval between them;

Number of cassettes packaged: five (5), pre-contained in the P cases;

Time of passage through the shrinking tunnel 18: 12 seconds, for the length 1,115 mm of the shrinking tunnel 18;

Temperature set inside the shrinking tunnel 18: within the range of ±5° C. with reference to the preset temperature, throughout the shrinking tunnel 18.

Results of evaluating the package with Samples F-J in Table 2 are illustrated in Table 5.

TABLE 5

| Samples | F | G | H | I | J |
|---|---|---|---|---|---|
| Heat shrinkability (%) | 20 | 30 | 40 | 50 | 60 |
| Amounts of wrinkles (lines/$cm^2$) | 0.1 [A] | 0.1 [A] | 0.5 [A] | 1.3 [A] | 2.3 [C] |
| Image quality | Good | Good | Good | Good | Good |
| Resistance to drop impact | Fair | Fair | Good | Good | Good |
| Guaranteed virginity | Failure | Fair | Good | Good | Good |

wherein [A] represents a Good range from 0 to 2 wrinkles per $cm^2$;

[B] represents a Fair range from 2.1 to 2.3 wrinkles per $cm^2$;

[C] represents a Failure range from 2.3 or more wrinkles per $cm^2$.

In Table 5, the amounts of wrinkles are numbers of wrinkles per unit area, and were obtained by counting the number of wrinkles existing outside the collective package after the shrink wrapping, and dividing the number by the surface area. The image quality was obtained in use with the photo film Fujicolor Super G400 (trade name; manufactured by Fuji Photo Film Co., Ltd.). The photo film was removed from the completed collective package, developed, and evaluated by measuring the density Dmin of fogging in blue color, as the blue is the color likely to be the most conspicuous when fogged. To evaluate fogging density, the measured density was compared with the standard fogging density Dmin=9.0±0.02 of the same photo film Super G400 and without being packaged in the shrink wrap.

To obtain the resistance to drop impact, a plurality of samples respectively inclusive of five P cases were subjected to "Performance testing for packaged freights" in accordance with the JIS-Z-0200 standard. For the guaranteed virginity (originality), one of the P cases 2 was detached from the collective package 1 along the perforation trains 8. It was checked whether the cap 5 could be removed only by direct application of force to it, namely whether the cap 5 could be removed only after removing the shrinkable film 7.

As is understood from Table 5, it is preferable for the uniaxial stretched film of 40 μm thickness to have heat shrinkability of 40% or more, in view of the resistance to drop impact and the guaranteed virginity. Should the heat shrinkability be lower than 40%, the resistance to drop impact would be low. Should the heat shrinkability be higher than 63%, excessive wrinkles would occur. Preferable heat shrinkability is from 40 to 63%.

Then Samples A–E of Table 1 were subjected to the same process of the shrink wrapping. The perforation trains were formed at the length of 1 mm and the interval of 2 mm, and oriented in the direction of stretch of the shrink film. In other words, a tearing load along the perforation trains 8 was applied in the direction crosswise to the direction of stretch.

Results of the evaluation are indicated in Table 6. The resistance to drop impact and the guaranteed virginity were obtained in the same fashion as Table 5. A ratio of failure in the resistance to drop impact is indicated in percentage. To obtain the guaranteed virginity, ten randomly selected persons of various ages and sexes manually cut off one P case 2 from the collective package 1, to evaluate good or poor separability (openability). To obtain the tensile strength across each perforation train, tensile load applied by a tensile machine was measured.

TABLE 6

| Samples | A | B | C | D | E |
|---|---|---|---|---|---|
| Thickness (μm) | 30 | 35 | 40 | 50 | 60 |
| Failure in resistance to drop impact (%) | 20 | 10 | 1 or less | 1 or less | 1 or less |
| Separability along perforations | Good | Good | Good | Fair | Failure |
| Tensile strength across perforation train (gf per 15 mm width) | 440 | 500 | 550 | 660 | 780 |
| Guaranteed virginity | Fair | Good | Good | Good | Good |
| Image quality | Good | Good | Good | Good | Good |

It has been found that the preferred thickness of the shrinkable film is from 30 to 50 μm, and desirably from 35 to 40 μm. Should the tensile strength across the perforation train be higher than 630 gf per 15 mm width, the separability would be low. Accordingly the preferable tensile strength across the perforation train is 630 gf (per 15 mm width) or lower. To avoid separation along the perforation in when the package is dropped, at least 400 gf per 15 mm width is required.

To check an optimum direction of stretch of the shrinkable film, Samples K and L of Table 3 with biaxial stretched film and Sample C of Table 1 were tested in a manner similar to Tables 5 and 6, to obtain the results in Table 7. Note that the perforation trains were formed at the length of 1 mm and the interval of 2 mm. To provide the same separability, it is possible for a perforation length and an interval to have other values with the remaining proportion 1:2.

TABLE 7

| Samples | C | K | L |
|---|---|---|---|
| Thickness (μm) | 40 | 40 | 40 |
| Failure in resistance to drop impact (%) | 1 or less | 1 or less | 1 or less |
| Separability along perforations | Good | Good | Fair |
| Tensile strength across perforation train (gf per 15 mm width) | 550 | 640 | 720 |
| Guaranteed virginity | Good | Good | Good |
| Image quality | Good | Good | Good |
| Amounts of wrinkles (lines/cm$^2$) | 0.5 | 2.7 | 3 or more |

As illustrated in Table 7, the biaxial stretched film is difficult to tear, as it is likely to extend in the tearing direction. There is a problem in poor separability (openability). Also there occur a great amount of wrinkles, to cause a visually unpleasant appearance as goods for sale. It is concluded that the uniaxial stretch film is preferred as PE shrink film for packaging.

Separability also depends upon the arrangement of the perforation trains. Two kinds of perforation trains were evaluated. In the testing, Sample C in Table 1 was utilized. Sample C-1 had the shrinkable film with perforation trains formed at the length of 1 mm and the interval of 2 mm. Sample C-2 had the shrinkable film with perforation trains formed at the length of 1 mm and the interval of 1 mm. Results of the evaluation are shown in Table 8.

TABLE 8

| Samples | C-1 | C-2 |
|---|---|---|
| Thickness (μm) | 40 | 40 |
| Failure in resistance to drop impact (%) | 1 or less | 5 |
| Perforation pitch | 1:2 | 1:1 |
| Separability along perforations | Good | Excellent |
| Tensile strength across perforation train (gf per 15 mm width) | 550 | 420 |
| Guaranteed virginity | Good | Good or Fair |
| Amounts of wrinkles (lines/cm$^2$) | 0.5 | 2.5 |

Sample C-2 had excellent separability, but still had problems in the amount of wrinkles, the guaranteed virginity, and the resistance to drop impact. Sample C-1 having the perforation pitch of 1:2 exhibited better performance.

The results described above are graphed as illustrated in FIGS. 7 to 11 in quantitative fashion.

Figure 7:
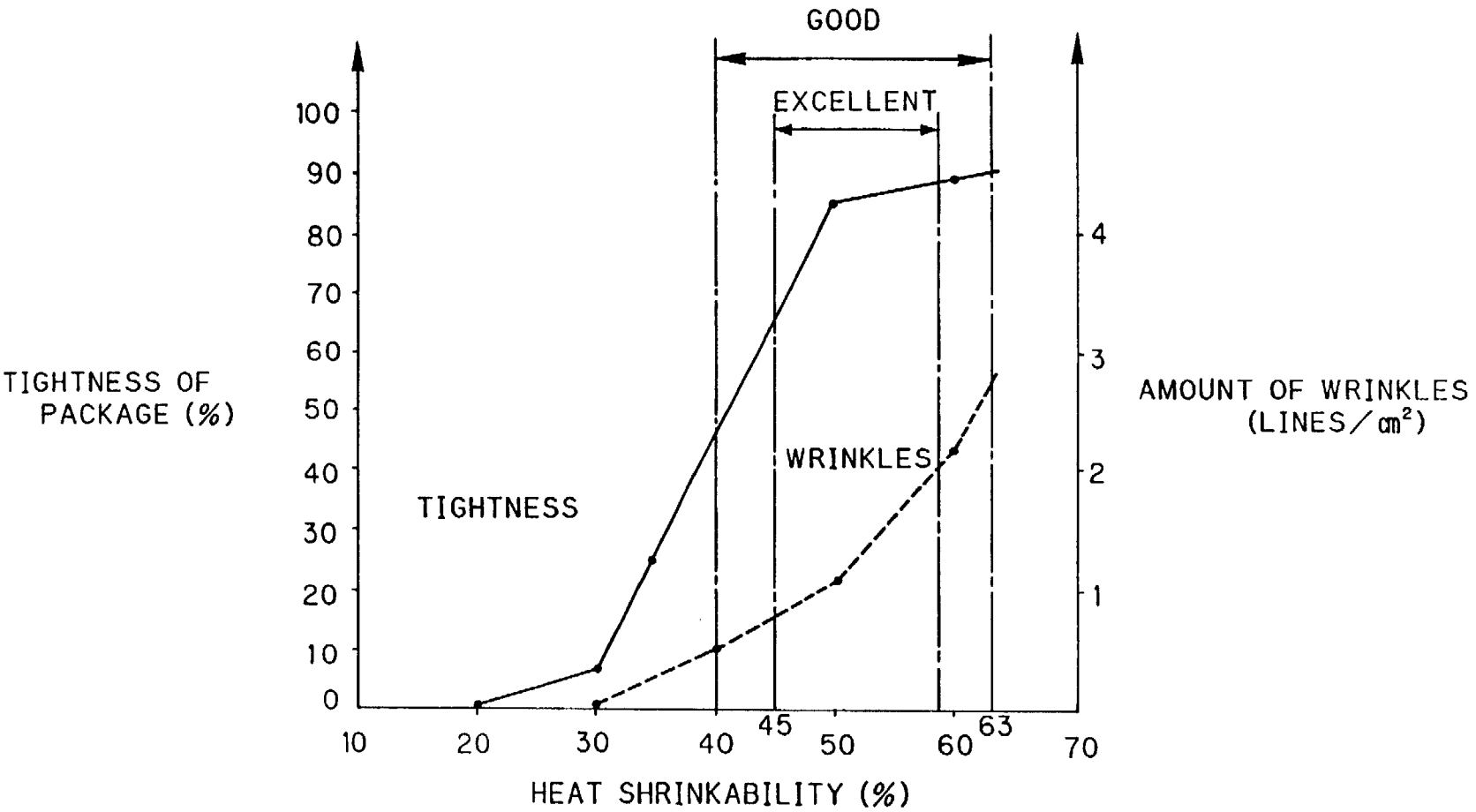
FIG. 7 is a graph illustrating relationships between the tightness of package and the heat shrinkability, and between the amount of wrinkles and heat shrinkability.

FIG. 7 illustrates a correlation of the heat shrinkability of the shrinkable film and the tightness and the amount of wrinkles of the collective package. The tightness is expressed as a percentage, and represents a proportion of a difference between the volume of the packaged object and the capacity of the shrinkable film, with reference to the capacity of the shrinkable film. Let Pv (in cm$^3$) be the volume of the packaged five P cases. Let Sv (in cm$^3$) be the capacity of the shrinkable film. The tightness K is defined as:

$$K=[1-\{(Sv-Pv)/Pv\}]\times 100$$

Let the five P cases have the volume Pv of 250 cm$^3$. Let the shrinkable film 7 have the capacity Sv (≈2 Pv) of 500 cm$^3$ before being shrunken. Let the shrinkable film 7 come to have the volume Sv of 400 cm$^3$ after heat application for shrinking at 140° C. for 8 seconds. The tightness K, before shrinking, is $$K = [1 - \{(500 - 250)/250\}] \times 100 = 0(\%)$$

and after shrinking, $$K = [1 - \{(400 - 250)/250\}] \times 100 = 40(\%)$$

As is understood from FIG. 7, a collective package with good performance can be obtained if the heat shrinkability is between 40 and 63%, as values of wrinkles and tightness are suitable. In particular, a collective package can have excellent performance if the heat shrinkability is between 45 and 59%, as the tightness is 65% or higher, and the amount of wrinkles is 2 lines per cm$^2$.

Figure 8:
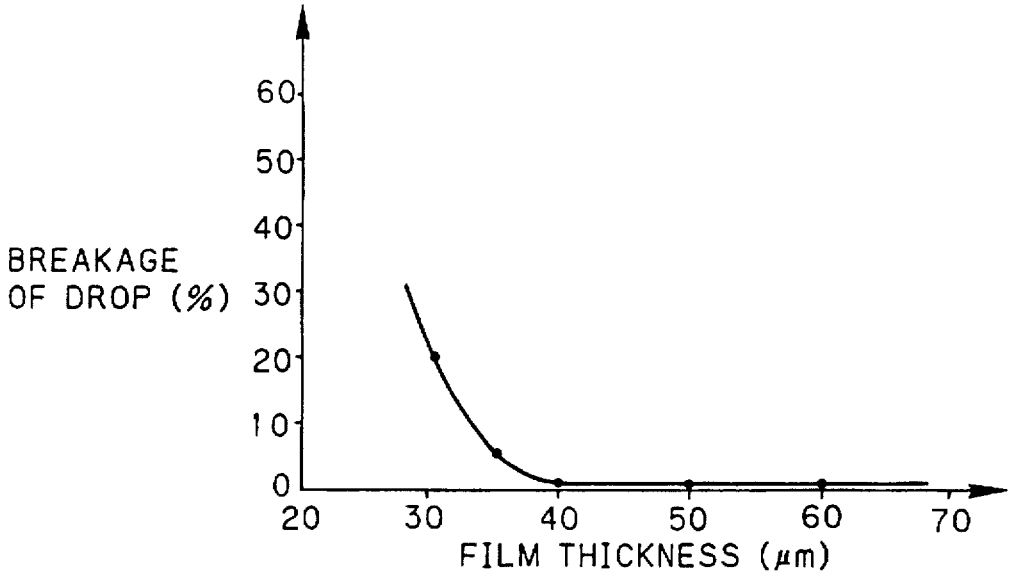
FIG. 8 is a graph illustrating a relationship between the breakage of drop and the film thickness.

FIG. 8 illustrates a correlation between the thickness of the shrinkable film and a ratio of the breakage due to a drop.

To obtain the breakage due to a drop, samples were tested according to the "Performance testing for packaged freights" defined in JIS-Z-0200. The number of samples having breakage is expressed as a percentage. It is found that the preferable thickness of the shrinkable film is 35 μm or more. Further, a correlation between the thickness and the tensile strength across the perforation train was obtained and is illustrated in FIG. 9.

Figure 9:
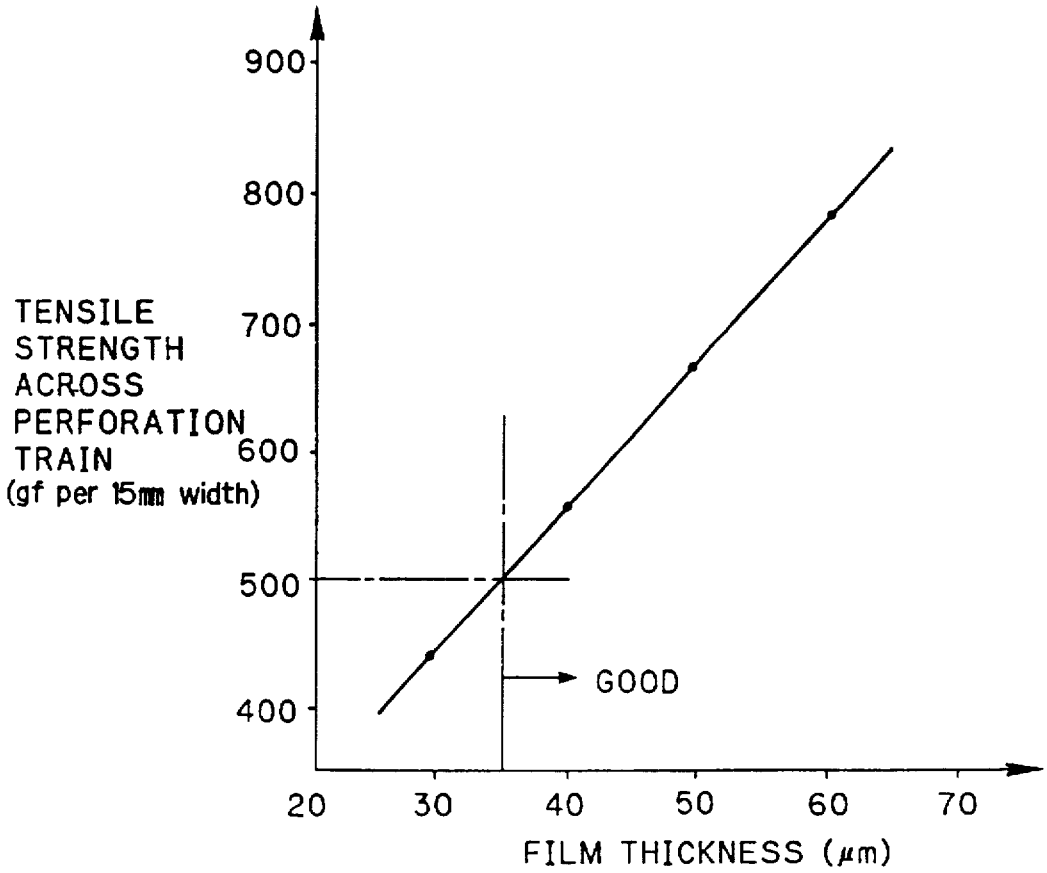
FIG. 9 is a graph illustrating a relationship between the tensile strength across a perforation train and the film thickness.

In FIG. 9, the "tensile strength across the perforation train" is represented by a tensile load which was applied to the perforation train by a tensile machine and obtained at the time of tearing the perforation train. The perforation pitch was set as 1:2. The shrinking process was effected at the temperature of 140° for 10 seconds. The tensile strength across the perforation train should be 500 gf per 15 mm width, for the purpose of maintaining the virginity (originality) by avoiding accidental tears of the perforation train when dropped. It is preferable for the shrinkable film to have thickness of 35 μm or more. Note that, if a shrinkable film is thicker with the perforation pitch kept unchanged, the separability (openability) is low. For such a thicker film, it is possible form the film with a changed perforation pitch to lower the tensile strength across the perforation train below 630 gf per 15 mm width.

Figure 10:
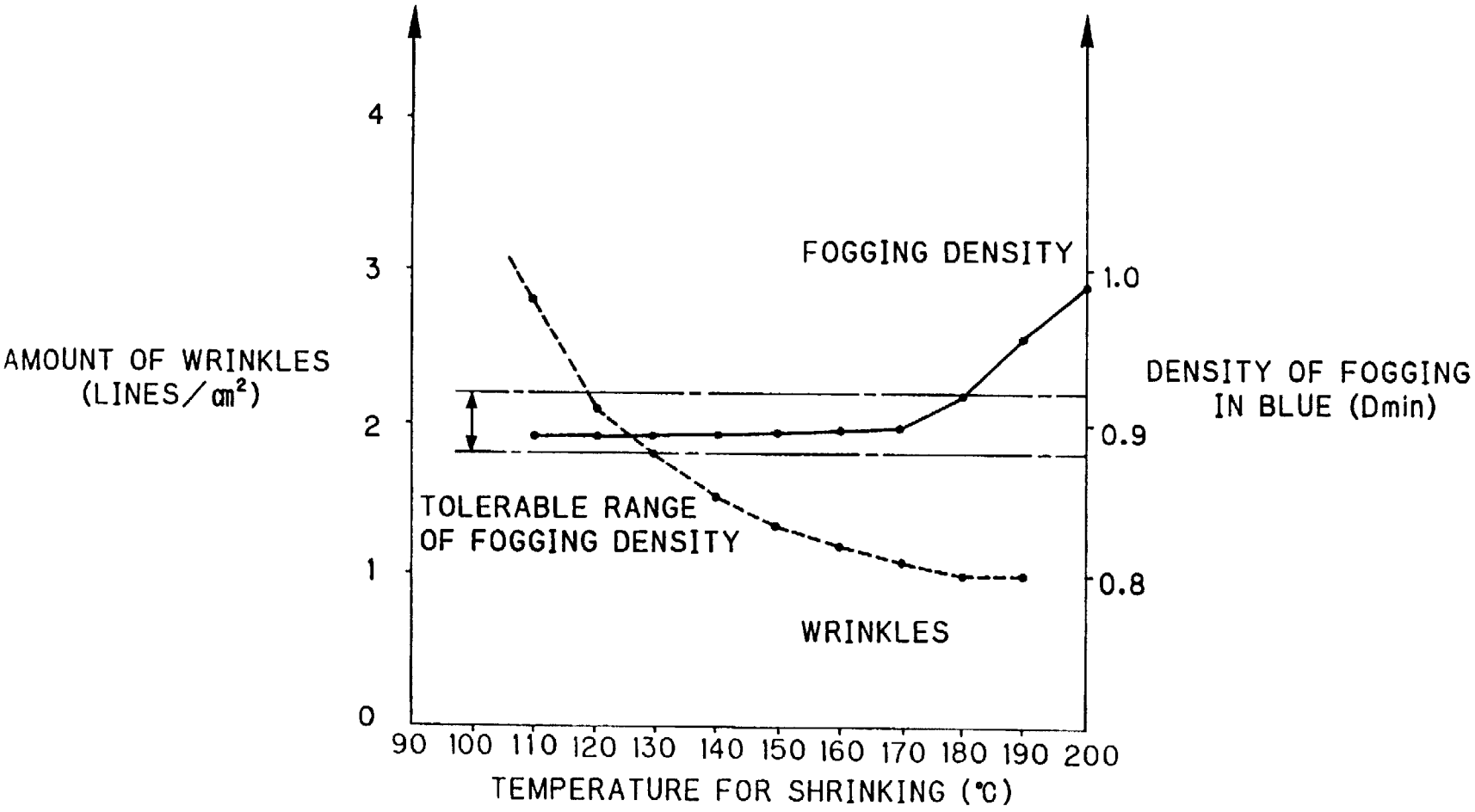
FIG. 10 is a graph illustrating relationships between the amount of wrinkles and the temperature of the shrinking process, and between the density of fogging in blue and the temperature of the shrinking process.

FIG. 10 illustrates the correlation between the temperature during shrinking process inside the shrinking tunnel, the amount of wrinkles, and the density of fogging a photo film in the blue color. To keep the fogging density within the tolerable range, the shrinking temperature can be set 180° C. at the highest to avoid the possible creation of pinholes due to thermal melting of the shrinkable film, the shrinking temperature can be set to 170° C. at the highest.

Should the temperature be 110° C. or lower, the shrinkable film would be shrunken incompletely and will have many wrinkles. In the range between 110° and 120° C., there would still a problem of conspicuous wrinkles. When the temperature is from 125° to 155° C., there are a sufficiently reduced number of wrinkles. When the temperature is from 155° to 170° C., the perforations are lengthened by thermal shrinking of the film, but can be adjusted in size and pitch in consistency with the performance of the film. Should the temperature be 180° C. or higher, the fogging density would be beyond the tolerable range. Even at 170° C. or higher, pinholes would be created due to thermal melting of the shrinkable film, which would also yield an unpleasant appearance. It is concluded that the range of the temperature of shrinking process can be preferably from 120° to 170° C., and most desirably from 125° to 155° C.

Figure 11:
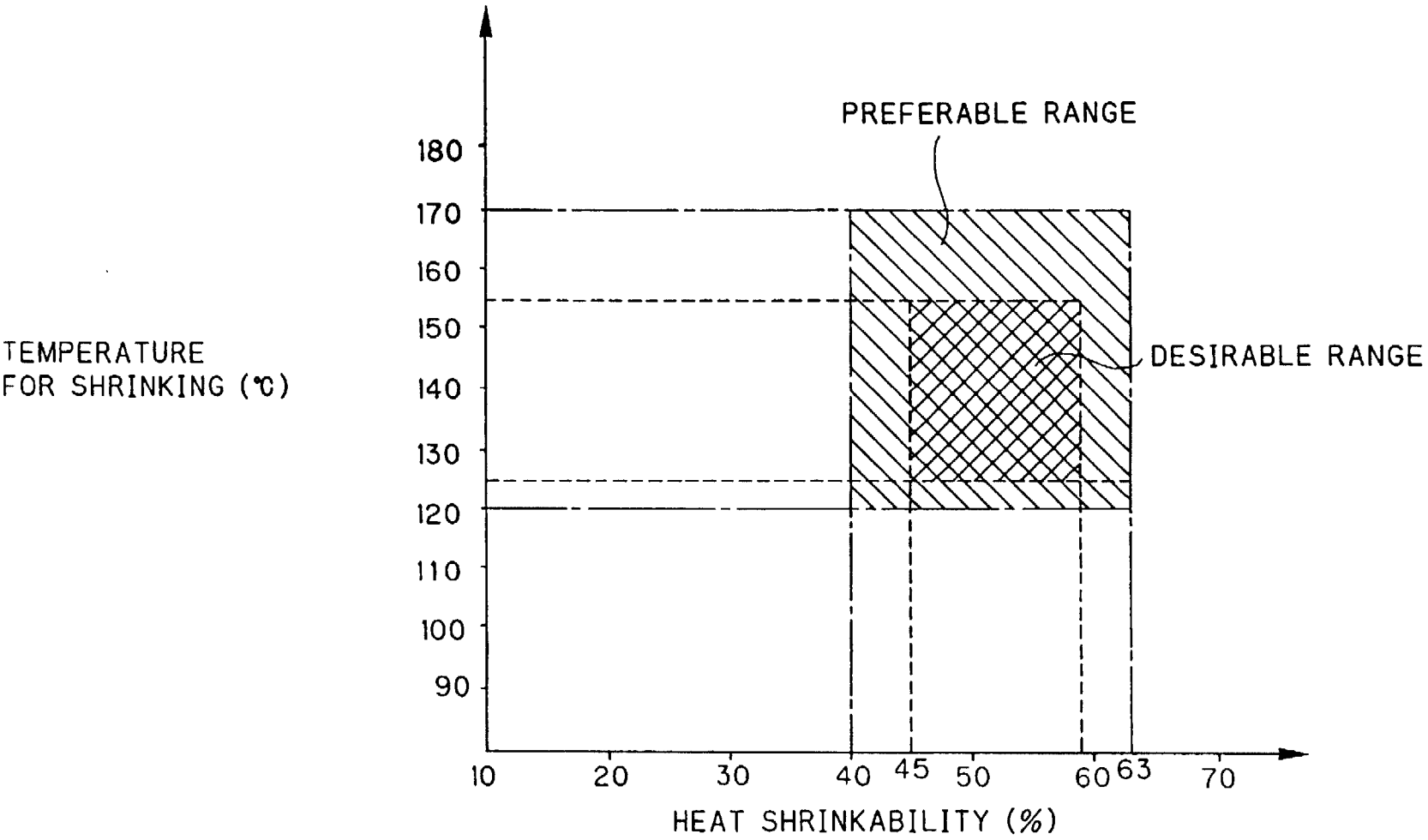
FIG. 11 is a graph illustrating preferred ranges of the temperature of the shrinking process and the heat shrinkability in combination.

FIG. 11 illustrates ranges where appearance of the collective package is agreeable by suitably determining the heat shrinkability and shrinking temperature. It is preferable to set the temperature between 120° and 170° C. and the heat shrinkability between 40 and 63%. It is desirable to set the temperature between 125° and 155° C. and the heat shrinkability between 45 and 59%.

In the present embodiment, it is likely that the junctures 9 are deviated from the center of the P cases 2. This is because the film material 7*a* is pulled to a greater extent than the film material 7*b* during the heat sealing at the sealing pad 20. The film materials 7*a* and 7*b* are obliged to be different in speed in transportation.

Figure 12:
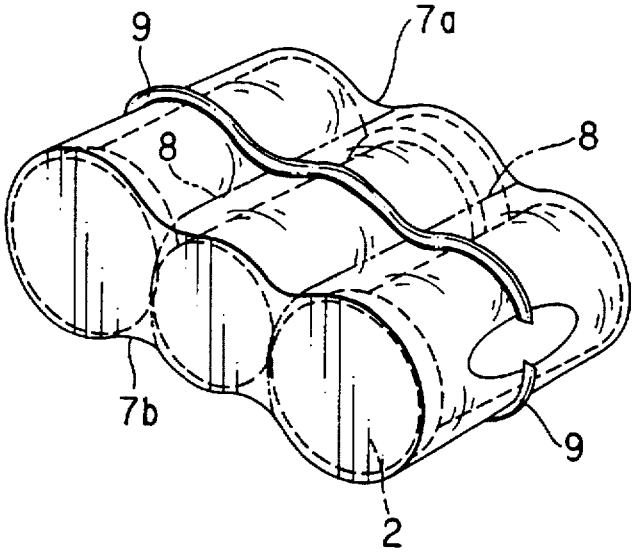
FIGS. 12 and 13 are perspective views illustrating other preferred collective packages.
Figure 13:
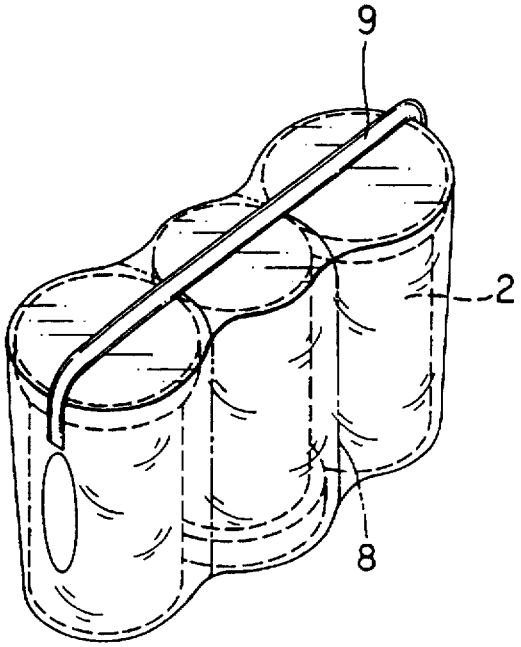

FIGS. 12 and 13 illustrate other preferred collective packages. In FIG. 12, the three P cases 2 are packaged with the film materials 7*a* and 7*b*. The sealed portions between the film materials 7*a* and 7*b* are located in front and rear midway positions of the series of the P cases 2. The junctures 9 lie crosswise to the P cases 2. FIG. 12 has the two shrinkable film pieces 7*a* and 7*b*. This is favorable in reducing the cost of packaging. FIG. 13 in turn illustrates the package inclusive of a single shrinkable film. There is only a single juncture 9, which is preferable in good appearance of the package.

Figure 14:
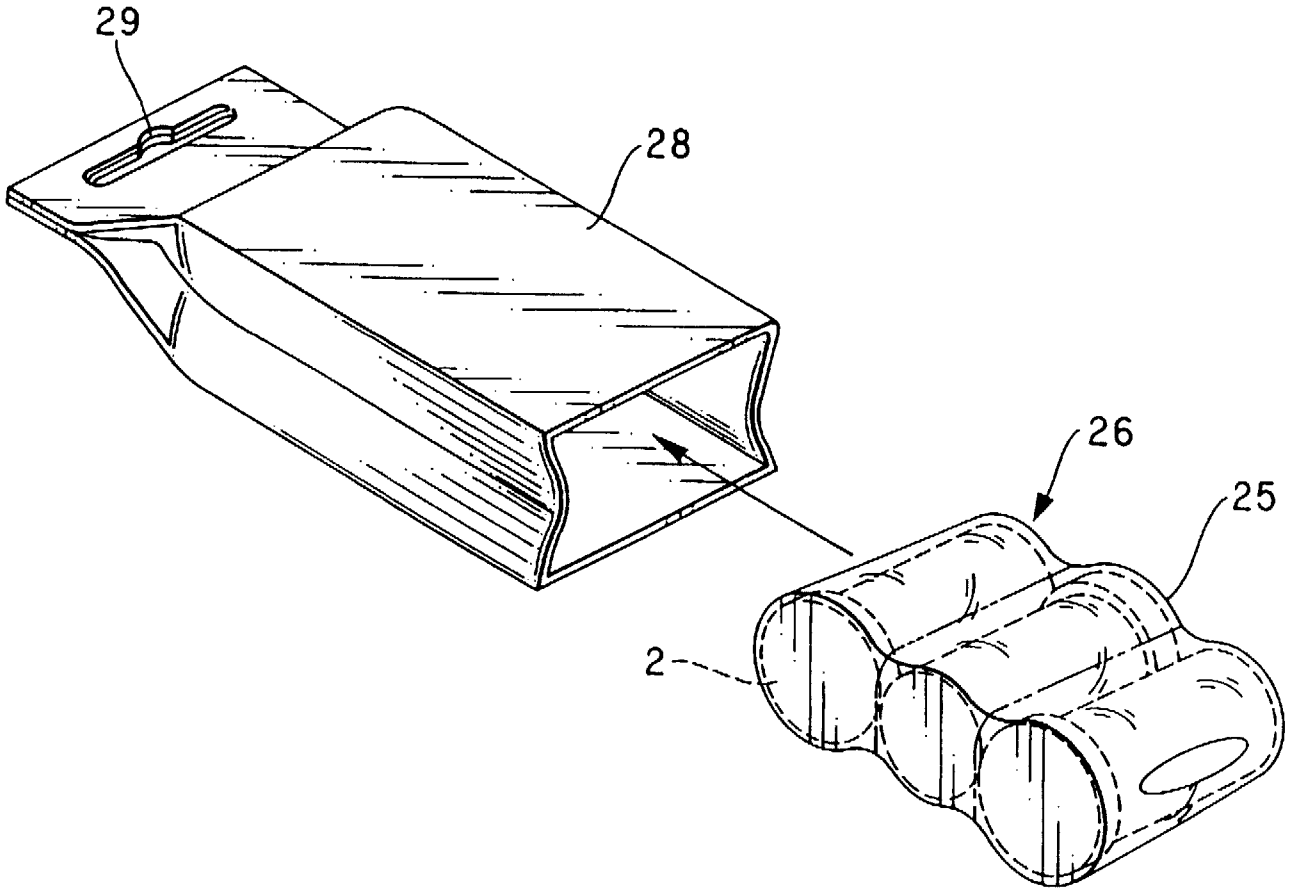
FIG. 14 is a perspective view illustrating an embodiment in which a collective package is covered in an outer bag.

FIG. 14 illustrates another preferred collective package 26. A shrinkable film 25 has a tubular shape, into which polyethylene resin has been melted and formed according to the inflation like a sleeve. The shrinkable film 25 is different from the former shrinkable film 7, as it has no sealed juncture. The collective package 26 is enveloped in a watertight outer gusseted bag 28 of the pillow type packaging, to be shipped for sale in a highly watertight fashion. The gusseted bag 28 has a hole 29, at which the gusseted bag 28 is suspended on a hanger in a photo shop or store. It is preferable to contain the collective package of FIG. 12, 13 or 14 in a similar watertight outer bag. An automatic packaging machine (or an operator manually) operates for containing the collective package 26 into the gusseted bag 28. The collective package 26 has the three P cases 2. It is easy in the present invention for the automatic packaging machine to effect the packaging process as compared with the conventional manner in which each single P case with a photo film cassette 3 is packaged. Efficiency in the auto mated packaging process is raised. Note that the collective package 26 may be contained in a packaging box of paper.

Figure 15:
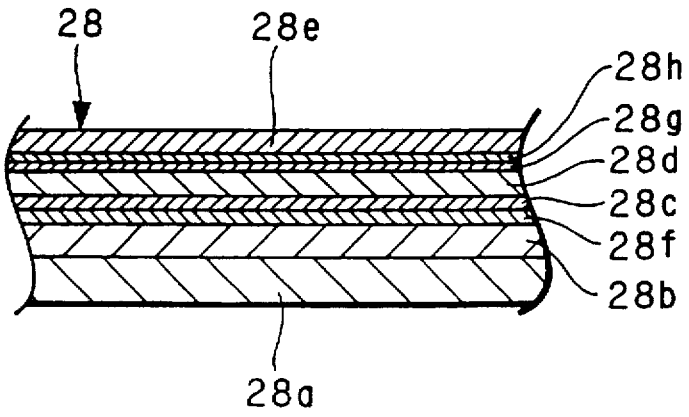
FIG. 15 is an explanatory view in section, illustrating a layered structure of the bag of FIG. 14; A

The layered structure of the gusseted bag 28 is illustrated in FIG. 15. An ethylene vinyl alcohol layer (EVA) 28*a*lies the innermost around shrinkable film, and is 40 μm thick. A polyethylene (PE) layer 28*b* is 20 μm thick. An aluminum foil layer 28*c* is 7 μm thick. A PE layer 28*d* is 15 μm thick. A polyester film layer 28*e* is 12 μm thick. There are anchor coats 28*f* and 28*g* formed inside the aluminum foil layer 28*c* and outside the PE layer 28*d*. Outside the anchor coat 28*g* is formed a printed layer 28*h*, which is ink placed for indicating a product name, a manufacturer name, and the like. Note that the present invention is also applicable to use of any of known outer bags, which only must operate as a cover with decorative appearance as goods for sale, while the P cases and the shrinkable film protects the photo film sufficiently.

In the above packaging apparatus, the junctures 9 between the film materials 7*a* and 7*b* are formed with a somewhat great width, and are likely to deviate from the center of the top and bottom of the P cases 2. Another preferred embodiment is referred to next, in which a juncture between the film pieces can be less conspicuous and disposed in the center with greater exactness.

Figure 16:
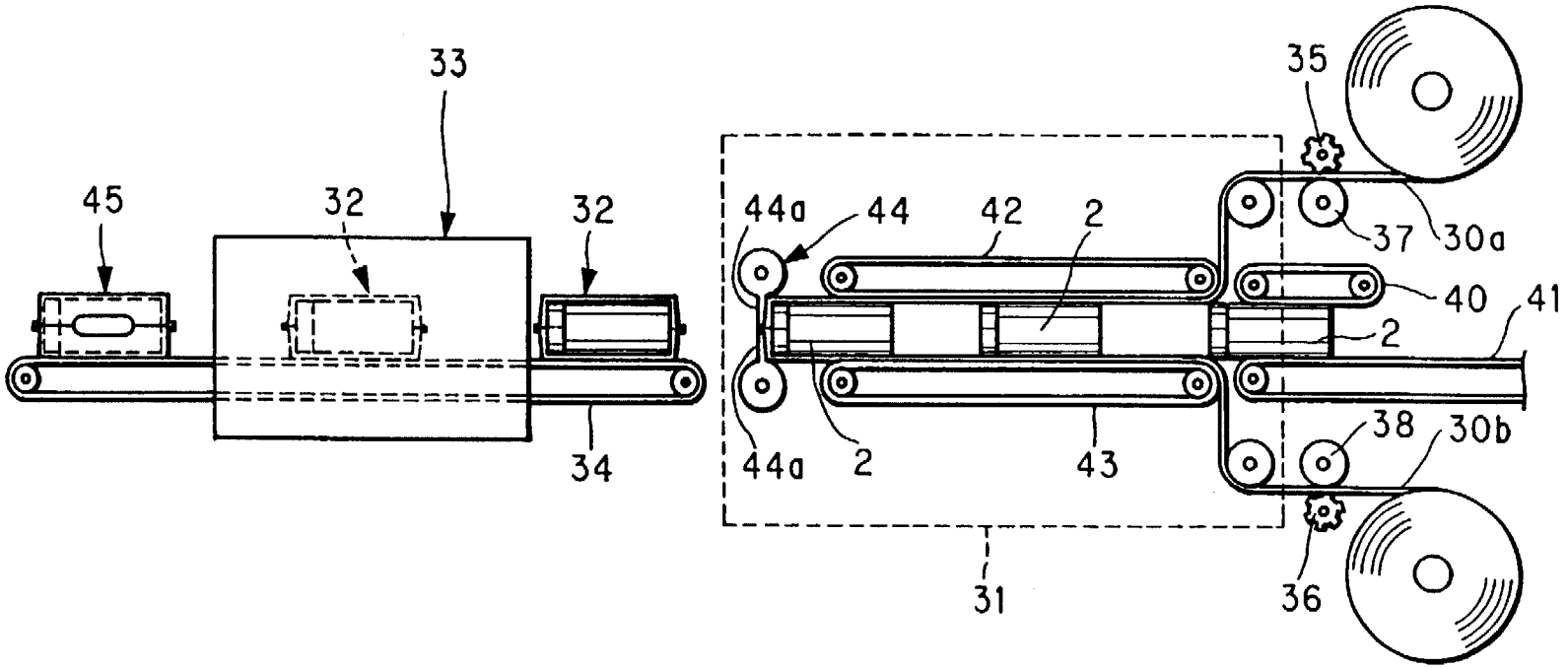
FIG. 16 is a schematic view in section, illustrating another preferred packaging apparatus, in which a juncture between shrinkable film pieces can be less conspicuous.

FIG. 16 illustrates the packaging apparatus. Shrinkable film materials 30*a* and 30*b* are wound as rolls. A wrapping unit 31 wraps the five P cases 2 loosely between the film materials 30*a* and 30*b*. A transport belt 34 transports a workpiece 32 inclusive of the P cases 2 and the film materials 30*a* and 30*b*, toward a shrinking tunnel 33. In the middle of a transport path of the film material 30*a* are disposed a bladed wheel 35 for forming each of perforation trains 46 and a roller 37 confronting the bladed wheel 35 while squeezing the film material 30*a*. In the middle of a transport path of the film material 30*b* are disposed a bladed wheel 36 and a roller 38.

The P case 2 is supplied to the wrapping unit 31 by supply belts 40 and 41 which are disposed between the film materials 30*a* and 30*b*. The supply belts 40 and 41 squeeze a plurality of the P cases 2, and at the same time transport the P cases 2 to the rear of the wrapping unit 31.

In the wrapping unit 31 are disposed upper and lower transport belts 42 and 43, and heating rollers 44 called "rotary heaters" in the art. The heating rollers 44 rotate with movement of the P cases 2 for the purpose of heat-sealing of the film materials 30*a* and 30*b*. The transport belts 42 and 43 are rotated while contacted respectively on the film materials 30*a* and 30*b*, and draw the film materials 30*a* and 30*b* into the wrapping unit 31. Five P cases 2 are inserted between the film materials 30*a* and 30*b* while transported. Accordingly the P cases 2 are transported by the transport belts 42 and 43.

The heating rollers 44 incorporate a heater. There is a sealing pad 44*a* projected from a circular portion of the heating rollers 44. The heating rollers 44 are rotated with movement of the P cases 2. The sealing pads 44*a* squeeze the film materials 30*a* and 30*b*, heat-seal them together upstream from the P cases 2, and cut the film materials 30*a* and 30*b* at the same time. After the film materials 30*a* and 30*b* are heat-sealed, the sealing pads 44*a* push the P cases 2 to the transport belt 34.

The workpiece 32 moved to the transport belt 34 is passed through the shrinking tunnel 33. The shrinking tunnel 33 has a heater, which generate heat inside the shrinking tunnel 33 to shrink the film materials 30*a* and 30*b* thermally at a suitable ratio. Upon passing of the workpiece 32 through the shrinking tunnel 33, a collective package 45 is produced with the film materials 30*a* and 30*b* shrunken and fitted outside the P cases 2. The packaging apparatus can produce approximately 100 collective packages per minute.

Figure 17:
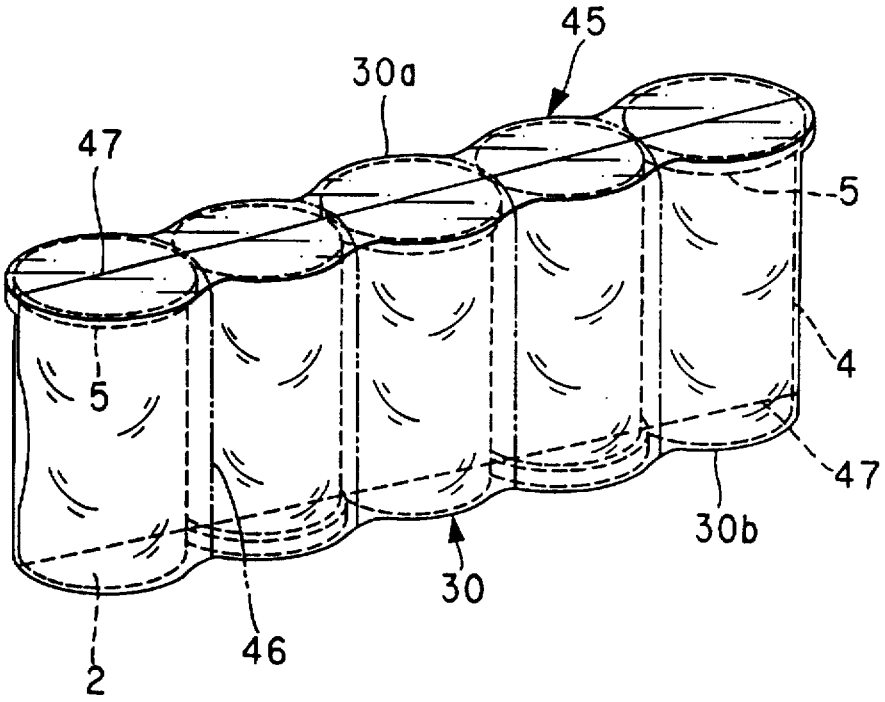
FIG. 17 is a perspective view illustrating a collective package produced by the apparatus of FIG. 16.

In the packaging apparatus, junctures 47 of the film materials 30*a* and 30*b* can be formed in linear fashion as illustrated in FIG. 17. The junctures 47 can be disposed exactly in the center of the top and bottom of the P cases 2. The film materials 30*a* and 30*b* are transported at one common speed, and do not require complicated speed control.

Another preferred embodiment is now referred to. In the collective package produced from either of the former packaging apparatus, the two junctures are formed in the shrinkable film. There is a possibility that perforation trains are deviated from exact positions between the P cases, due to deviation in fitting the shrinkable film pieces together. In such a case the collective package has a visually poor appearance as goods for sale. To solve such problems, the other preferred packaging apparatus is constructed to form a single juncture in the shrinkable film, and to dispose perforation trains in a proper position.

Figure 18:
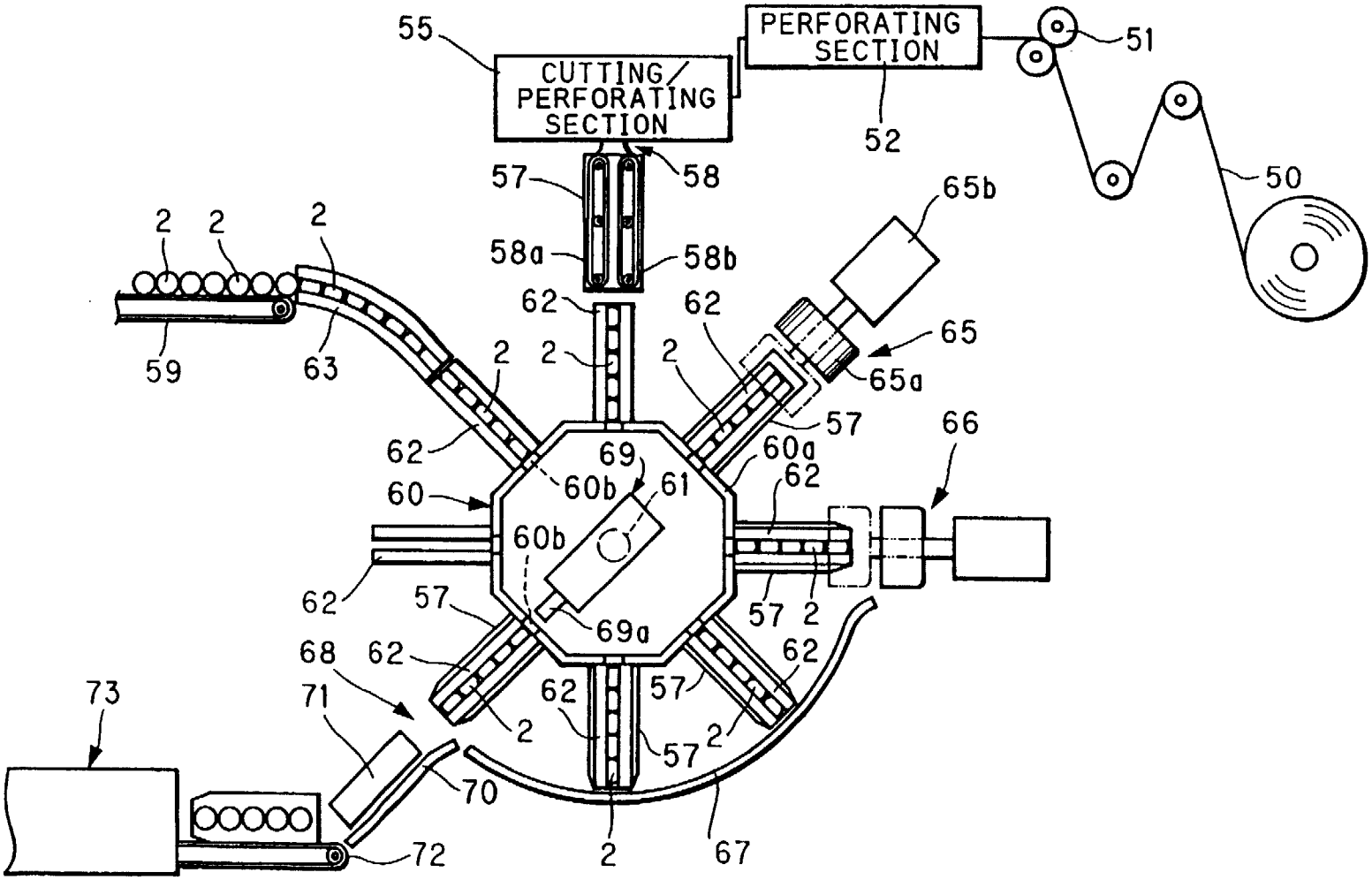
FIG. 18 is a schematic view in section, illustrating still another preferred packaging apparatus of an upright type.
Figure 19:
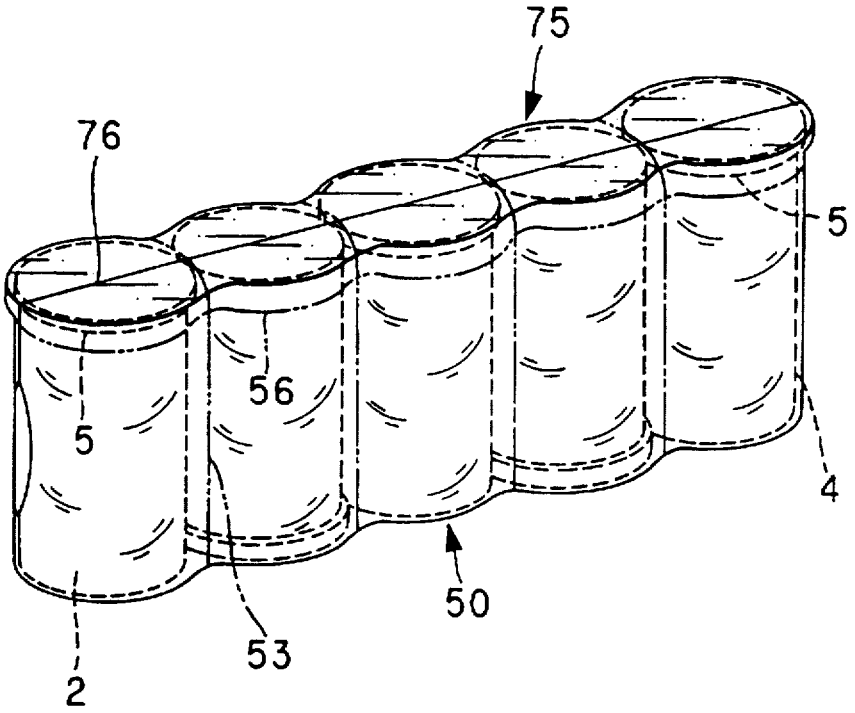
FIG. 19 is a perspective view illustrating a collective package produced by the apparatus of FIG. 18.

FIG. 18 illustrates a packaging apparatus of an upright type. The film tube material 50 having a continuous length is previously treated for welding, is given a tubular shape, and is wound in roll form. The film tube material 50 unwound from the roll is sent by a transport roller set 51 to a perforating section 52. The perforating section 52 forms perforation trains 53 in the film tube material 50 and along borders between the P cases 2, as illustrated in FIG. 19.

The film tube material 50 passed through the perforating section 52 is sent to a cutting/perforating section 55. The cutting/perforating section 55 forms a crosswise arranged train of perforations 56 illustrated in FIG. 19 and adapted to removal of all the P cases 2 from the film tube material 50. The cutting/perforating section 55 also cuts a film tube piece 57 from the film tube material 50 at a regular length sufficient for packaging of the five P cases 2. The film tube piece 57 is opened in a tubular shape, and is set to a film guide arm 58, which includes two guide belts 58*a* and 58*b*. The film tube piece 57 is set to cover the guide belts 58*a* and 58*b*. The guide belts 58*a* and 58*b* are rotated, to move the film tube piece 57 down.

The P case 2 is supplied by a supply belt 59 to a rotary indexing device 60, which is shaped in a regular octagon, and has peripheral walls 60*a*. The rotary indexing device 60 is rotatable about a shaft 61, and is driven by a motor (not shown) to rotate intermittently. Holders 62 are disposed about the rotary indexing device 60 and oriented radially. Each of the holders 62 contains the five P cases 2. The P cases 2 supplied from the transport belt 59 are guided through a guide path 63, and inserted into the one holder 62.

The rotary indexing device 60 is rotated in intermittent fashion. The holder 62 holding the P cases 2 is moved to come under the guide arm 58. The guide belts 58*a* and 58*b* rotate to move the film tube piece 57 down and wrap the holder 62 in the film tube piece 57. The rotary indexing device 60 makes one other eighth of one rotation, to move the holder 62 with the film tube piece 57 to a first preheating section 65. The first preheating section 65 includes a cup-shaped heater 65*a* and solenoid 65*b*. The heater 65*a* is moved by the solenoid 65*b* toward the holder 62, to wrap around an end of the film tube piece 57, for preheating the film tube piece 57. The heater 65*a* thermally shrinks the end of the film tube piece 57. Note that it is possible to use a cam, an air cylinder, or the like in place of the solenoid.

The rotary indexing device 60 further makes one eighth of one rotation, to move the holder 62 with the film tube piece 57 to a second preheating section 66. The second preheating section 66 has the same construction as the first preheating section 65, and applies further heat to the end of the film tube piece 57, thermally to close the end completely.

When the rotary indexing device 60 is rotated further, the holder 62 with the film tube piece 57 is directed to the bottom. There is a guide plate 67 arranged outside the orbit of the holder 62. The guide plate 67 prevents the P cases 2 and the film tube piece 57 from dropping out of the holder 62.

When the holder 62 with the film tube piece 57 comes to an exit station 68, a pressing device 69 inside the rotary indexing device 60 protrudes a pressing rod 69*a* through a hole 60*b* in the walls 60*a*, so that the pressing rod 69*a* presses the P cases 2. The P cases 2 are moved with the film tube piece 57 out of the holder 62 to a guide plate 70. There is a heater 71 disposed beside the guide plate 70 for heating a side face of the film tube piece 57.

The film tube piece 57 with the P cases 2, preheated by the heater 71, is placed on a transport belt 72 and transported to a shrinking tunnel 73. The film tube piece 57 is heated inside the shrinking tunnel 73, shrunken, and becomes fitted around the five P cases 2, as a collective package 75 in FIG. 19.

The collective package 75 produced by the packaging apparatus has only a single juncture 76, which has been previously given to the film tube material 50 and has a small and inconspicuous width. No matter where the juncture 76 is placed around the collective package 75, appearance of the collective package 75 is hardly affected. The juncture 76 may be located in a suitable position with ease. The perforation trains 53 formed by the perforating section 52 are disposed exactly between the P cases 2. The crosswise perforation train 56 formed by the cutting/perforating section 55 is disposed also suitably. The present packaging apparatus can produce approximately 50 to 60 collective packages 75 per minute.

The shrinkable films of all the above embodiments are polyethylene. The present invention is applicable to the use of any other material of shrinkable films having the features of the claims of the present invention. In the above embodiments, the shrinkable films are transparent or translucent in the raw, unprocessed state. It is also possible to use colored shrinkable films, or printed shrinkable films with a pattern inclusive of a product name, a manufacturer name, and other product information. Examples of inks used for coloring or printing to the shrinkable films are as follows:

1) Organic pigments:

Azo pigments—insoluble pigments including monoazo pigment and disazo pigment, azo lake, condensation azo pigment, and chelate azo pigment;

Polycyclic pigments—phthalocyanine type, anthraquinone type, perylene type, perinone type and thioindigo type;

dying lake—alkali dye and acid dye;

others—azine pigment, daylight fluorescent pigment, nitroso, and nitro pigment.

2) Non-organic pigments:

Titanium dioxide, lead sulfate, zinc oxide, iron black, chrome yellow, zinc yellow, chrome vermilion, red oxide (colcothar), cobalt violet, ultramarine blue, Prussian blue, chrome green, chrome oxide, and cobalt green.

3) Paints:

Oily paints—epoxy urea (solvent: xylene and butanol), polyester (solvent: Cellosolve acetate), and polyester amino (solvent: xylene, Cellosolve acetate);

UV paints—epoxy acrylate, polyester acrylate, polyurethane acrylate.

The above packaging apparatus wrap the five P cases 2. However the present invention is applicable to packaging of more or less than five P cases. In the above embodiments, the photo films with the cassettes are packaged. However the present invention is applicable to packaging of other photosensitive material, such as photographic paper, and with any container, such as cartridge or magazine. The P case can be replaced with other cylindrical cases. Among the three preferred embodiments of the present invention, the one depicted in FIG. 16 has the greatest efficiency in packaging. The one depicted in FIG. 18 can package the photo film visibly in the most agreeable fashion. The one depicted in FIG. 3 has the lowest cost for the packaging. Any of the embodied packaging apparatuses can be selected according to a requirement for the particular design of the packaging.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A packaging apparatus for packaging photosensitve material, said photosensitive material contained in a plurality of cassettes, said cassettes contained in respective watertight cylindrical cases, said packaging apparatus comprising:

a cassette supply device for supplying N of said cassettes in N of said cylindrical cases;

a film supply device for supplying at least one continuous heat shrinkable film material to a top and a bottom of said N cylindrical cases from said cassette supply device;

a guide device for guiding said shrinkable film material from said film supply device, to cause said shrinkable film material to touch and cover said N cylindrical cases;

a heat sealing device for sealing a rear edge portion and a front edge portion of said shrinkable film material with heat, said rear edge portion disposed upstream from an initial N cylindrical cases covered in said shrinkable film material, and said front edge portion disposed downstream from a next N cylindrical cases to be covered in said shrinkable film material;

a cutting device for cutting said rear edge portion from said front edge portion, a shrinkable film piece of a regular length covering said initial N cylindrical cases;

a pressing device for pressing said next N cylindrical cases toward said front edge portion sealed with heat by said heat sealing device, said shrinkable film material touching and covering said next N cylindrical cases; and a shrinking tunnel through which said shrinkable film piece is passed with said initial N cylindrical cases, and which applies a controlled amount of heat based on a heat tolerance characteristic of said photosensitive material to said shrinkable film piece so that said shrinkable film piece shrinks to fit tightly on said cylindrical cases without damaging said photosensitive material.

2. A packaging apparatus as defined in claim 1, further comprising:

a perforator, disposed between said film supply device and said guide device, for forming a perforation train in said shrinkable film material during transport thereof to said guide device;

said heat sealing device and said cutting device being incorporated in a unit;

further comprising a roller, disposed downstream from said guide device and opposite to said heat sealing device and said cutting device with reference to said shrinkable film material, for supporting said shrinkable film material while said shrinkable film material is accessed by said heat sealing device and said cutting device.

3. A packaging apparatus as defined in claim 2, wherein said shrinkable film material has shrinkability from 40 to 63% when heated at 140° C. for 10 seconds and has thickness from 35 to 50 μm.

4. A packaging apparatus for packaging photosensitive material, said photosensitive material contained in a plurality of cassettes, said cassettes contained in respective cylindrical watertight cases, said packaging apparatus comprising:

a cassette supply device for supplying N of said cassettes in N of said cylindrical watertight cases;

a film supply device for supplying at least one continuous heat shrinkable film material to a top and a bottom of said N cylindrical cases from said cassette supply device;

first and second transport devices, disposed downstream from said cassette supply device and opposite to one another with reference to said cylindrical cases supplied, for transporting said shrinkable film material while sandwiching said N cylindrical cases with said shrinkable film material, to cause said shrinkable film material to touch and cover said N cylindrical cases;

a heating/cutting device, disposed downstream from said first and second transport devices, for sealing a rear edge portion and a front edge portion of said shrinkable film material with heat, and for cutting said rear edge portion from said front edge portion, said rear edge portion disposed upstream from an initial N cylindrical cases covered in said shrinkable film material, and said front edge portion disposed downstream from a next N cylindrical cases to be covered in said shrinkable film material, a shrinkable film piece of a regular length covering said initial N cylindrical cases; and a shrinking tunnel through which said shrinkable film piece is passed with said initial N cylindrical cases, and which applies a controlled amount of heat based on a heat tolerance characteristic of said photosensitive material to said shrinkable film piece so that said shrinkable film piece tightly shrinks to fit on said cylindrical cases without damaging said photosensitive material.

5. A packaging apparatus as defined in claim 4, wherein said first and second transport devices respectively comprise a conveyor belt.

6. A packaging apparatus as defined in claim 4, further comprising:

a perforator, disposed between said film supply device and said first and second transport devices, for forming a perforation train in said shrinkable film material during supply thereof to said first and second transport devices;

said heating/cutting device including:

first and second rollers, disposed opposite to one another with reference to said cassettes supplied, and rotated with transport of said N cylindrical cases from said first and second transport devices; and first and second sealing pads, projected respectively from said first and second rollers, for squeezing said shrinkable film material transported therebetween, and for heating and cutting said shrinkable film material.

7. A packaging apparatus as defined in claim 6, wherein said shrinkable film material has shrinkability from 40 to 63% when heated at 140° C. for 10 seconds and has thickness from 35 to 50 μm.

8. A packaging apparatus for packaging photosensitive material, said photosensitive material contained in cassettes, said cassettes contained in respective cylindrical watertight cases, said packaging apparatus comprising:

a perforator for forming at least one perforation train in a continuous shrinkable film material, said shrinkable film material being pre-formed in a tubular shape;

a film cutting device for cutting a shrinkable film piece from said shrinkable film material from said perforator at a regular length;

a rotary indexing device, having plural holders disposed thereabout and directed radially, said holders respectively adapted to holding N cylindrical cases at one time; said rotary indexing device rotatable to move said holders past plural stations for packaging; said plural stations for packaging including:

a cassette supply station for supplying said holders with said N cassettes associated with said cylindrical watertight cases;

a film guide station for opening said shrinkable film piece from said film cutting device in said tubular shape, and for causing said shrinkable film piece to cover one of said holders supplied with said N cylindrical cases from said cassette supply station;

a preheating station for applying heat to one end of said shrinkable film piece from said film guide station, to close said one end of said shrinkable film piece;

an exit station for exiting said N cylindrical cases with said shrinkable film piece from said one holder with said one end closed;

further comprising a shrinking tunnel through which said shrinkable film piece is passed with said N cylindrical cases from said exit station, and which applies a controlled amount of heat based on a heat tolerance characteristic of said photosensitive material to said shrinkable film piece so that said shrinkable film piece shrinks to touch and fit tightly on said cylindrical watertight cases without damaging said photosensitive material.

9. A packaging apparatus as defined in claim 8, wherein said rotary indexing device is rotated about an axis oriented substantially horizontally;

said holders are directed upward at said cassette supply station by said rotary indexing device; and further comprising a pressing device, disposed in said rotary indexing device, and actuated at said exit station, said holder being directed downward at said exit station by said rotary indexing device, said pressing device pressing said N cylindrical cases out of said holders.

10. A packaging apparatus as defined in claim 9, wherein said shrinkable film material has shrinkability from 40 to 63% when heated at 140° C. for 10 seconds and has thick-ness from 35 to 50 μm.

11. A packaging method of packaging photosensitive material, said photosensitive material contained in each of cassettes, said packaging method comprising steps of:

pre-containing N of said cassettes in respective cylindrical watertight cases;

supplying said N cassettes associated with said N watertight cases;

supplying at least one continuous heat shrinkable film material to a top and a bottom of said N cylindrical cases;

guiding said shrinkable film material, to cause said shrinkable film material to touch and cover said N cylindrical cases;

sealing a-rear edge portion and a front edge portion of said shrinkable film material with heat, said rear edge portion disposed upstream from an initial N cylindrical cases covered in said shrinkable film material, and said front edge portion disposed downstream from a next N cylindrical cases to be covered in said shrinkable film material;

cutting said rear edge portion from said front edge portion, a shrinkable film piece of a regular length covering initial said N cylindrical cases;

pressing said next N cylindrical cases toward said front edge portion sealed with heat, said shrinkable film material covering said next N cylindrical cases; and applying a controlled amount of heat based on a heat tolerance characteristic of said photosensitive material to said shrinkable film piece with said initial N cylindrical cases, to touch and fit said shrinkable film piece tightly on said cylindrical watertight cases without damaging said photosensitive material.

12. A packaging method of packaging photosensitive material, said photosensitive material contained in cassettes, said packaging method comprising steps of:

pre-containing N of said cassettes in respective cylindrical watertight cases;

supplying said N cassettes in said N cylindrical watertight cases;

supplying at least one continuous heat shrinkable film material to a top and a bottom of said N cylindrical cases;

transporting said shrinkable film material while sandwiching said N cylindrical cases with said shrinkable film material, to cause said shrinkable film material to cover said N cylindrical cases;

sealing a rear edge portion and a front edge portion of said shrinkable film material with heat, said rear edge portion disposed upstream from an initial N cylindrical cases covered in said shrinkable film material, and said front edge portion disposed downstream from a next N cylindrical cases to be covered in said shrinkable film material;

cutting said rear edge portion from said front edge portion, a shrinkable film piece of a regular length covering initial said N cylindrical cases; and applying a predetermined amount of heat based on a heat tolerance characteristic of said photosensitive material to said shrinkable film piece with said initial N cylindrical cases, to fit said shrinkable film piece tightly on said cylindrical cases without damaging said photosensitive material.

13. A packaging method of packaging photosensitive material, said photosensitive material contained in cassettes, said packaging method comprising steps of:

pre-containing N of said cassettes in respective cylindrical watertight cases;

forming at least one perforation train in a continuous shrinkable film material, said shrinkable film material being pre-formed in a tubular shape;

cutting a shrinkable film piece from said shrinkable film material at a regular length;

arranging plural holders in radially directed fashion and rotatably, said holders respectively adapted to holding N cylindrical cases at one time;

supplying one of said holders with said N cassettes associated with said cylindrical watertight cases in a direction toward a center of arrangement of said holders;

causing said shrinkable film piece to cover said one holder, by opening said shrinkable film piece in said tubular shape, while said N cylindrical cases are held in said one holder;

applying heat to one end of said shrinkable film piece about said one holder, in said direction toward said center, to close said one end of said shrinkable film piece;

moving said N cylindrical cases away from said center of said arrangement of said holders, to exit said N cylindrical cases with said shrinkable film piece from said one holder; and applying a predetermined amount of heat based on a heat tolerance characteristic of said photosensitive material to said shrinkable film piece with said N cylindrical cases, to touch and fit said shrinkable film piece tightly on said watertight cases without damaging said photosensitive material.

14. A packaging apparatus as defined in claim 2, wherein said perforator forms (N−1) trains of perforations, each train positioned between two of said N cylindrical cases to thereby facilitate dispensing one cylindrical case at a time.

15. A packaging apparatus as defined in claim 6, wherein said perforator forms (N−1) trains of perforations, each train positioned between two of said N cylindrical cases to facilitate dispensing of one cylindrical case at a time.

16. A packaging apparatus as defined in claim 9, wherein said at least one perforation train includes:

(N−1) trains of perforations, each train positioned between two of said N cylindrical cases, said perforation trains adapted to separation of said N cylindrical cases from one another; and at least one crosswise perforation train, disposed crosswise to said N cylindrical cases and adapted to collective removal of said N cylindrical cases from said shrinkable film.

17. A packaging apparatus as defined in claim 1, wherein said apparatus is operable to output at least twenty packages of N cylindrical cases per minute.

18. A packaging apparatus as defined in claim 1, wherein said amount of heat is also based on a heat response characteristic of said shrinkable film.

19. A packaging apparatus as defined in claim 8, wherein said amount of heat is also based on a heat response characteristic of said shrinkable film.

20. A packaging method as defined in claim 13, wherein said amount of heat is also based on a heat response characteristic of said shrinkable film.

* * * * *